US008579424B2

(12) United States Patent
Haijima et al.

(10) Patent No.: US 8,579,424 B2
(45) Date of Patent: Nov. 12, 2013

(54) IMAGE FORMING LIQUID CARTRIDGE AND IMAGE FORMING APPARATUS

(75) Inventors: Akimitsu Haijima, Kanagawa (JP); Masahiko Kondo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 184 days.

(21) Appl. No.: 13/352,348

(22) Filed: Jan. 18, 2012

(65) Prior Publication Data

US 2012/0211121 A1 Aug. 23, 2012

(30) Foreign Application Priority Data

Feb. 18, 2011 (JP) ..... 2011-033988

(51) Int. Cl.
*B41J 2/175* (2006.01)

(52) U.S. Cl.
USPC ..... 347/86

(58) Field of Classification Search
USPC ..... 347/84, 85, 86, 87; 277/320, 371, 626, 277/627; 604/86, 88, 256, 264
See application file for complete search history.

(56) References Cited

U.S. PATENT DOCUMENTS

| | | | | |
|---|---|---|---|---|
| 5,657,058 | A * | 8/1997 | Mochizuki et al. | 347/7 |
| 6,554,412 | B1 * | 4/2003 | Seino et al. | 347/86 |
| 7,334,888 | B2 * | 2/2008 | Sasaki et al. | 347/86 |
| 7,871,157 | B2 * | 1/2011 | Koike et al. | 347/86 |
| 2001/0048457 | A1 | 12/2001 | Hara et al. | |
| 2004/0100540 | A1 | 5/2004 | Hatasa et al. | |
| 2005/0151810 | A1 | 7/2005 | Graham et al. | |
| 2005/0257506 | A1 | 11/2005 | Nanjo et al. | |
| 2006/0017790 | A1 | 1/2006 | Jin | |

FOREIGN PATENT DOCUMENTS

| | | | |
|---|---|---|---|
| EP | 0688836 | A | 12/1995 |
| EP | 1090767 | A | 4/2001 |
| JP | 7-290717 | A | 11/1995 |
| JP | 2007-038537 | A | 2/2007 |
| JP | 2009-221253 | A | 10/2009 |
| WO | 2006116698 | A | 11/2006 |

* cited by examiner

*Primary Examiner* — Anh T. N. Vo
(74) *Attorney, Agent, or Firm* — SOLARIS Intellectual Property Group, PLLC

(57) ABSTRACT

The invention provides an image forming liquid cartridge including a container having an opening portion from which an image forming liquid is fed or discharged; a cap portion connected to the opening portion; and an image forming liquid contained in the container, the image forming liquid including a colorant, urea and water, and having a pH of 7.5 or more, wherein the cap portion includes a sealing portion that seals the opening portion, a contact portion provided at the center of the sealing portion, and at least one first breakage portion that extends from the contact portion to an outer periphery of the sealing portion, and has a thickness of from 0.1 mm to 0.5 mm, the thickness of the at least one first breakage portion being smaller than a thickness of the sealing portion.

13 Claims, 17 Drawing Sheets

IMAGE FORMING LIQUID CARTRIDGE AND IMAGE FORMING APPARATUS

CROSS-REFERENCE TO RELATED APPLICATIONS

This application is based on and claims priority under 35 USC 119 from Japanese Patent Application No. 2011-033988 filed on Feb. 18, 2011, the disclosures of which are incorporated by reference herein.

BACKGROUND

1. Technical Field

The present invention relates to an image forming liquid cartridge, including a liquid container containing an image forming liquid, and an image forming apparatus equipped with the image forming liquid cartridge.

2. Related Art

An image forming apparatus employing a droplet discharge recording system, in which a liquid for printing such as ink is discharged in the form of droplets from a recording head, is known as image forming apparatuses such as printers; facsimile machines, copiers, plotters and combined machines thereof.

In some of the image forming apparatuses employing a droplet discharge recording system, a liquid is supplied from a printing liquid container to a recording head or a main tank that communicates with the recording head.

For example, an ink supply unit is known in which ink is supplied to a recording head from a liquid container via a hole formed by punching a sealing portion that seals an opening of the liquid container with a punch (see, for example, Japanese Patent Application Laid-Open (JP-A) No. 7-290717). In this apparatus, specifically, an ink hole is formed in the sealing portion made of a thin film, and the thin film is stretched with a punching unit to enlarge the ink hole, whereby ink is allowed to flow out through the opening of the liquid container.

Further, a technique is known in which fine grooves are formed in a crossed manner or in a radial manner in a sealing portion that seals an opening of a liquid container, at a position at which the tip of a punch contacts first. Therefore, a hole can be formed on the sealing portion smoothly and a breakage having a uniform shape can be formed in the sealing portion (see, for example, JP-A No. 2007-38537).

On the other hand, when ink including a pigment as a resin component or as a colorant is solidified due to evaporation of a solvent component in the ink, the solidified ink may remain solid without re-dissolving. As a result, the solidified ink may accumulate at a nozzle tip or the like of an inkjet head that discharges ink, thereby blocking the ink discharge or altering the discharge direction. In addition, ease of maintenance of the inkjet head may be impaired due to difficulty in removing the ink attached to the inkjet head by wiping or the like. As a method of facilitating the removal of ink by wiping or the like, a technique of including a moisturizing agent or a wetting agent in ink is known, and urea is known as an example of the moisturizing agent. For example, an ink composition containing urea as a moisturizing agent in order to facilitate removal of the ink composition when it is dried and solidified in the vicinity of nozzles (see, for example, JP-A No. 2009-221253).

SUMMARY

According to an aspect of the present invention, there is provided an image forming liquid cartridge comprising:

a container having an opening portion from which an image forming liquid is fed or discharged;

a cap portion connected to the opening portion; and an image forming liquid contained in the container, the image forming liquid comprising a colorant, urea and water, and having a pH of 7.5 or more, wherein the cap portion comprises a sealing portion that seals the opening portion, a contact portion provided at the center of the sealing portion and adapted such that a punch member that punches the sealing portion contacts the contact portion, and at least one first breakage portion that extends from the contact portion to an outer periphery of the sealing portion, and has a thickness of from 0.1 mm to 0.5 mm, the thickness of the at least one first breakage portion being smaller than a thickness of the sealing portion.

BRIEF DESCRIPTION OF THE DRAWINGS

Exemplary embodiments of the present invention will be described in detail, based on the following figures, wherein.

DETAILED DESCRIPTION

Figure 1:
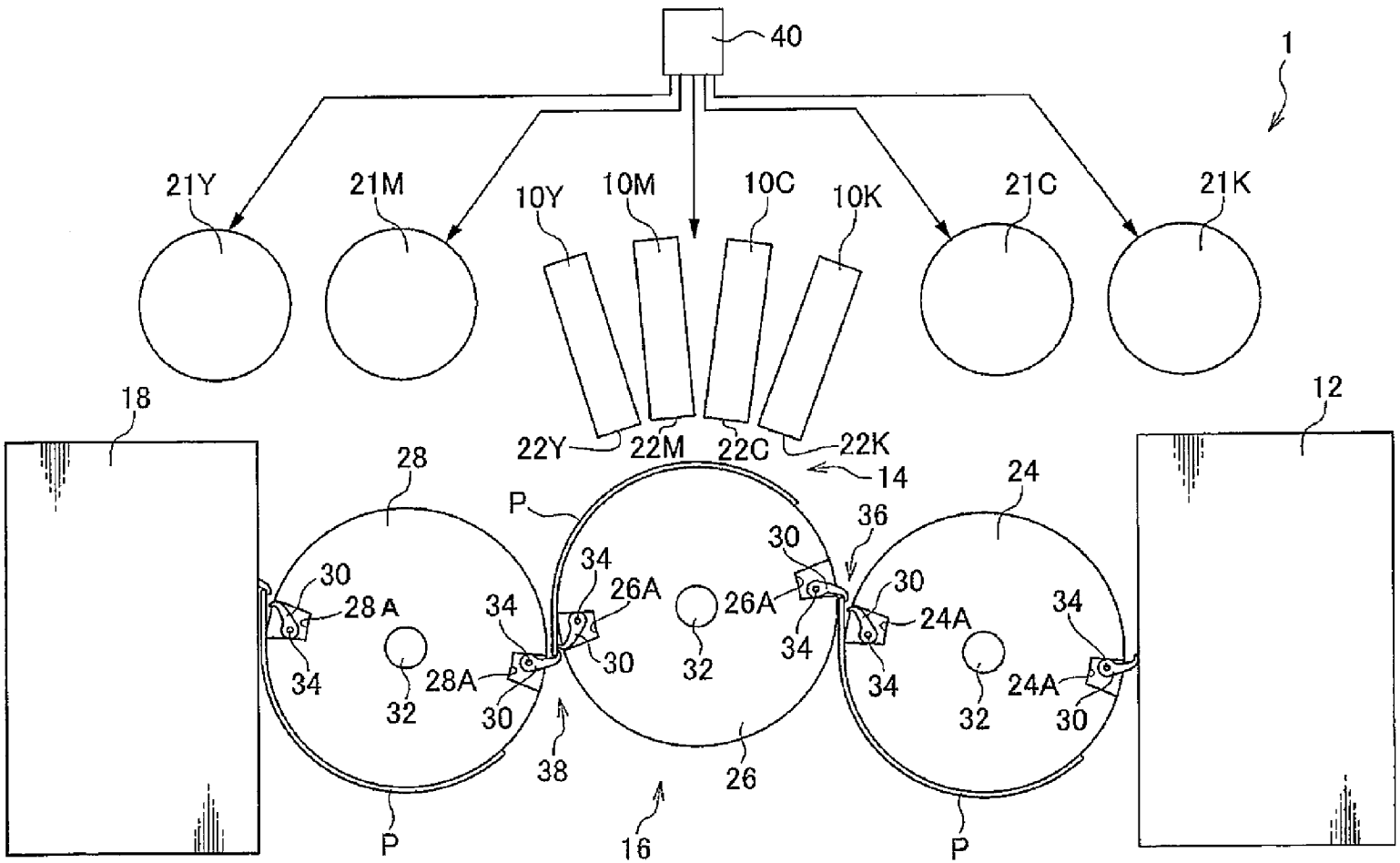
FIG. 1 is a schematic view of the entire body of an inkjet recording apparatus including an image forming liquid cartridge according to an exemplary embodiment of the invention.

In the following, the image forming liquid cartridge (hereinafter, also referred to as a liquid cartridge) according to the invention and the image forming apparatus equipped with the image forming liquid cartridge will be described in detail.

The liquid cartridge according to the invention includes a container having an opening portion from which an image forming liquid is fed or discharged, and a cap portion being connected to the opening portion of the container and having a sealing portion that seals the opening portion. The liquid container is filled with an image forming liquid that contains at least a colorant, urea and water. The liquid container filled with an image forming liquid is used for the purpose of replenishment, and can be attached to or removed from an image forming apparatus. At the center of the sealing portion of the cap portion, a contact portion at which a hole is formed with a punch member is formed, and a first breakage portion, which extends from the contact portion to the outer periphery of the sealing portion and has a thickness of from 0.1 mm to 0.5 mm, is provided.

In the invention, by providing a contact portion at which a punching unit contacts and forms a hole at the center of the sealing portion that seals the opening portion of the container, a stress is concentrated on the contact portion. As a result, the stress is easily transmitted to the first breakage portion having a small thickness, and the entire portion of the first breakage portion is easily broken. In addition, since the thickness of the first breakage portion, which extends from the contact portion toward the periphery of the sealing portion, is smaller than the thickness of the sealing portion, i.e., from 0.1 mm to 0.5 mm, a gas generated from urea contained in the image forming liquid escapes through the first breakage portion. As a result, the amount of the gas in the cartridge is maintained below a predetermined level, and a phenomenon in which the cartridge is significantly deformed can be suppressed. Consequently, deformation that may cause collapse of a pile of cartridges or damage to the cartridges can be prevented, while maintaining a certain level of impact strength against external force and securing a large opening area at the sealing portion.

First, an image forming liquid according to the invention will be described in detail.

The image forming liquid according to the invention is a water-based liquid composition at least containing a colorant, urea and water. For example, the image forming liquid is a colored liquid used as inkjet recording inks, printing inks, paints or the like for the purpose of image formation.

For example, when the image forming liquid is an ink composition for inkjet recording, the image forming liquid may contain other additives including a polymer component such as resin particles or wax particles, an organic solvent or a surfactant, in addition to the colorant, urea and water.

(Colorant)

The image forming liquid according to the invention contains at least one kind of colorant, and is prepared as a colored composition. The colorant is not particularly restricted, and known dyes, pigments or the like may be used as the colorant. Among these, from the viewpoint of the ink coloring power, the colorant is preferably a colorant that is insoluble or hardly soluble in water, particularly preferably a pigment. The pigment may be an organic pigment or an inorganic pigment.

Examples of the organic pigment include azo pigments, disazo pigments, azo lake pigments, quinacridone pigments, perylene pigments, anthraquinone pigments, polycyclic pigments, dye chelates, nitro pigments, nitroso pigments and aniline black. The organic pigment may be used alone or as a combination of two or more kinds mixed at a desired proportion.

Specific examples of a cyan pigment include C. I. Pigment Blue 1, 2, 3, 15, 15:1, 15:2, 15:3, 15:34, 16, 17:1, 22, 25, 56 and 60, and C.I. Vat Blue 4, 60 and 63. The cyan pigment is preferably a (copper) phthalocyanine pigment, particularly preferably C. I. Pigment Blue 15:3.

Specific examples of a magenta pigment include C. I. Pigment Red 48, 57, 122, 184 and 188, and C. I. Pigment Violet 19. The magenta pigment is preferably a quinacridone pigment, particularly preferably C. I. Pigment Red 122 and C. I. Pigment Violet 19.

Examples of the inorganic pigment include titanium oxide, iron oxide, calcium carbonate, barium sulfate, aluminum hydroxide, barium yellow, cadmium red, chromium yellow, and carbon black. Among these, carbon black is particularly preferred. Examples of the carbon black include those produced by a known method, such as a contact method, a furnace method or a thermal method, and specific examples thereof include furnace black, thermal lamp black, acetylene black and channel black.

Specific examples of the carbon black include Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080, Raven 1060, Raven 700 (manufactured by Columbian Chemicals Company), Regal 400R, Regal 330R, Regal 660R, Mogul L, Black Pearls L, Monarch 700, Monarch 800, Monarch 880, Monarch 900, Monarch 1000, Monarch 1100, Monarch 1300, Monarch 1400 (manufactured by Cabot Corporation), Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A, Special Black4 (manufactured by Evonik Degussa Japan Co., Ltd), No. 25, No. 33, No. 40, No. 45, No. 47, No. 52, No. 900, No. 2200B, No. 2300, MCF-88, MA600, MA7, MA8, MA100 (manufactured by Mitsubishi Chemical Corporation). However, the invention is not limited to these specific examples.

In the invention, it is preferred to disperse a pigment, which is contained as a colorant, in a liquid while coating with a pigment dispersant (preferably a water-insoluble resin). In this way, pigment particles can exist in the form of fine particles, and high dispersion stability can be achieved after the pigment particles are dispersed. In that case, the entire surfaces of the pigment particles do not necessarily need to be coated, and coating at least a portion of the particle surface may suffice in some cases.

The pigment is preferably in the form of a water-dispersible pigment from the viewpoint of liquid stability and discharge stability, and suitable embodiments include (1) encapsulated pigment, (2) self-dispersing pigment, (3) resin-dispersed pigment, and (4) surfactant-dispersed pigment.

(1) Encapsulated pigment is a polymer emulsion of polymer fine particles containing a pigment. More specifically, a pigment is dispersed in water by coating the pigment with a hydrophilic, water-insoluble resin such that the pigment surface is hydrophilized with a resin layer.

(2) Self-dispersing pigment is a pigment that has at least one kind of hydrophilic group at the surface thereof, and exhibits at least dispersibility in water or solubility in water in the absence of a dispersant. More specifically, the surface of a pigment, mainly carbon black or the like, is hydrophilized by performing an oxidation treatment such that the pigment can be dispersed in water by itself.

(3) Resin-dispersed pigment is a pigment dispersed by means of a water-soluble polymer compound having a mass average molecular weight of 50,000 or less.

(4) Surfactant-dispersed pigment is a pigment dispersed by means of a surfactant.

Among these, (1) encapsulated pigment or (2) self-dispersing pigment is more preferred, and (1) encapsulated pigment is particularly preferred. When the pigment exists in a liquid (e.g., an ink composition) in the form of a coated pigment, i.e., a pigment coated with a resin, removability of the liquid when it is dried and solidified can be improved by including urea, and the advantages of the invention can be more remarkable when an image forming liquid has such a liquid composition.

In the following, (2) self-dispersing pigment will be briefly explained.

For example, self-dispersing carbon black is a pigment treated with one or more kinds of functional groups (dispersibility-imparting groups) selected from the group consisting of —COOH, —CHO, —OH, —$SO_3H$ and a salt of these groups. The pigment can be uniformly dispersed in a water-based ink composition without further adding a dispersant. In the present specification, the term "dispersed" refers to a state in which self-dispersing carbon black exists in water in a stable manner without a dispersant, and includes not only a state of being dispersed but also a state of being dissolved. An image forming liquid (e.g., an ink composition) including self-dispersing carbon black exhibits high dispersion stability. Further, since the ink composition exhibits a moderate viscosity, more carbon black can be included in the ink composition, thereby making it possible to form an image with a favorable color density, especially on plain paper.

Self-dispersing carbon black can be prepared by, for example, chemically bonding a functional group or a molecule having a functional group to a pigment surface via coordination, grafting or the like, by performing a physical treatment or a chemical treatment such as vacuum plasma treatment. For example, self-dispersing carbon black can be obtained by a method described in JP-A No. 8-3498. Self-dispersing carbon black is available also as a commercial product, and preferred examples include MICROJET series (manufactured by Orient Chemical Industries Co., Ltd.) and CAB-O-JET series (manufactured by Cabot Corporation).

As a self-dispersing carbon black, a self-dispersing carbon black having a carboxyl group (—COOH) at a pigment surface is preferred.

In the following, (1) encapsulated pigment will be described in detail.

The resin used for the encapsulated pigment is not particularly limited, but preferably a polymer compound that exhibits self-dispersibility or dissolvability in a mixed solvent of water and water-soluble organic solvent, and has an anionic group (acidic). The resin typically preferably has a number average molecular weight of about 1,000 to 100,000, particularly preferably about 3,000 to 50,000. Further, the resin is preferably dissolved in an organic solvent to form a solution. When the number-average molecular weight of the resin is within the above range, the resin can function as a coating of a pigment, or as a coating film formed from ink in which the resin is used. The resin is preferably used in the form of a salt of an alkali metal or an organic amine.

Specific examples of the resins used for an encapsulated pigment include thermoplastic, thermosetting and modified resins including acrylic resins, epoxy resins, polyurethane resins, polyether resins, polyamide resins, unsaturated polyester resins, phenol resins, silicone resins and fluorine-based resins; polyvinyl resins such as vinyl chloride, vinyl acetate, polyvinyl alcohol and polyvinyl butyral; polyester resins such as alkyd resins and phthalic acid resins, amino-based materials such as melamine resins, melamine formaldehyde resins, amino alkyd cocondensated resins and urea resins, and materials having an anionic group such as a copolymer or a mixture of the aforementioned resins.

Among these resins, anionic acrylic resins can be obtained by, for example, polymerizing an acrylic monomer having an anionic group (hereinafter, also referred to as an anionic group-containing acrylic monomer) and, as necessary, another monomer that can be copolymerized with the anionic group-containing acrylic monomer, in a solvent. Examples of the anionic group-containing acrylic monomer include acrylic monomers having at least one anionic group selected from the group consisting of a carboxyl group, a sulfonic acid group and a phosphonic group, and an acrylic monomer having a carboxyl group is particularly preferred.

Specific examples of the acrylic monomer having a carboxyl group include acrylic acid, methacrylic acid, crotonic acid, ethacrylic acid, propylacrylic acid, isopropylacrylic acid, itaconic acid and fumaric acid. Among these, acrylic acid or methacrylic acid is preferred.

The encapsulated pigment can be produced by a conventional physical or chemical process, using a component as mentioned above. For example, the methods described in JP-A No. 9-151342, JP-A No. 10-140065, JP-A No. 11-209672, JP-A No. 11-172180, JP-A No. 10-25440 and JP-A No. 11-43636 can be used for the production of an encapsulated pigment. Specifically, the methods include a phase-transfer emulsification method and an acid deposition method described in JP-A No. 9-151342 and JP-A No. 10-140065. Among these, a phase-transfer emulsification method is preferred.

The phase-transfer emulsification method is basically a self-dispersing (phase-transfer emulsification) method in which a dissolved mixture of a resin having self-dispersibility or dissolvability and a pigment is dispersed in water. The dissolved mixture may include a curing agent or a polymer compound as mentioned above. In the present specification, the dissolved mixture include a state of being mixed without being dissolved, a state of being mixed and dissolved, and a combination thereof. Specific examples of the phase-transfer emulsification method include a method described in JP-A No. 10-140065.

For more specific processes of the phase-transfer emulsification method and the acid deposition method, JP-A No. 9-151342 and JP-A No. 10-140065 can be referred to.

The pigment is preferably an encapsulated pigment formed by coating at least a portion of a surface of the pigment with a water-insoluble resin as a pigment dispersant. For example, a polymer emulsion in which a pigment is contained in water-insoluble resin particles is preferred. More specifically, an embodiment in which at least a portion of a pigment is coated with a water-insoluble resin to form a resin layer on the pigment surface, such that the pigment can be dispersed in water, is preferred.

The content of a colorant (in particular, a pigment) in the image forming liquid is preferably from 0.1 to 15% by mass, more preferably from 0.5 to 12% by mass, with respect to the total solid content of the image forming liquid, from the viewpoint of color developability, granularity, ink stability, and discharge reliability.

The pigment dispersant can facilitate dispersion of the pigment and stabilize the dispersed state. The pigment dispersant can be appropriately selected from compounds that function to disperse a pigment in an aqueous phase. Examples of the pigment dispersant include nonionic compounds, anionic compounds, cationic compound and amphoteric compounds, such as a homopolymer or a copolymer of a monomer having an α,β-ethylenically unsaturated group. Exemplary monomers having an α,β-ethylenically unsaturated group include ethylene, propylene, butene, pentene, hexene, vinyl acetate, allyl acetate, acrylic acid, methacrylic acid, crotonic acid, crotonic acid ester, itaconic acid, itaconic acid monoester, maleic acid, maleic acid monoester, maleic acid diester, fumaric acid, fumaric acid monoester, vinyl sulfonate, styrene sulfonate, vinyl naphthalene sulfonate, vinyl alcohol, acrylamide, methacryloyloxyethyl acid phosphate, bismethacryloyloxyethyl phosphate, methacryloyloxyethylphenyl phosphate, ethylene glycol dimethacrylate, diethylene glycol dimethacrylate, styrene, styrene derivatives such as α-methyl styrene and vinyl toluene, vinyl cyclohexane, vinyl naphthalene, vinyl naphthalene derivative, acrylic acid alkyl ester that may have an aromatic group, acrylic acid phenyl ester, methacrylic acid alkyl ester that may have an aromatic group, methacrylic acid phenyl ester, methacrylic acid cycloalkyl ester, crotonic acid alkyl ester, itaconic acid dialkyl ester, maleic acid dialkyl ester, vinyl alcohol, and derivatives of these compounds.

The homopolymer or the copolymer of a monomer having an α,β-ethylenically unsaturated group may be used as a polymer dispersant. Specific examples include acrylic acid alkyl ester-acrylic acid copolymer, methacrylic acid alkyl ester-methacrylic acid copolymer, styrene-acrylic acid alkyl ester-acrylic acid copolymer, styrene-methacrylic acid phenyl ester-methacrylic acid copolymer, styrene-methacrylic acid cyclohexyl ester-methacrylic acid copolymer, styrene-styrene sulfonic acid copolymer, styrene-maleic acid copolymer, styrene-methacrylic acid copolymer, styrene-acrylic acid copolymer, vinyl naphthalene-maleic acid copolymer, vinyl naphthalene-methacrylic acid copolymer, vinyl naphthalene-acrylic acid copolymer, polystyrene, polyester, and polyvinyl alcohol.

The image forming liquid according to the invention preferably includes an encapsulated pigment, having at least a portion of its surface being coated with a water-insoluble resin, as a colorant.

Examples of the water-insoluble resin include: [1] a polymer having (a) a repeating unit represented by the following Formula (1) and (b) a repeating unit having an ionic group; and [2] a polymer having a repeating unit derived from (c) a monomer having a salt-forming group, and a repeating unit derived from (d) a styrene macromer and/or (e) a hydrophobic monomer. Among these, polymer [1] is preferred. Details of polymer [2] are described in paragraphs [0012] to [0031] of JP-A No. 2009-84501.

The term "water-insoluble" refers to a state in which the amount of a polymer dissolved in an aqueous medium at 25° C. is 10% by mass or less with respect to the total polymer mixed with the aqueous medium.

In the following, details of polymer [1], having (a) a repeating unit represented by Formula (1) and (b) a repeating unit having an ionic group, are described.

The polymer includes at least one kind of a repeating unit represented by the following Formula (1) and at least one kind of a repeating unit having an ionic group. As necessary, the polymer may further include a hydrophobic repeating unit other than the repeating unit represented by Formula (1), a hydrophilic repeating unit having a nonionic functional group, or the like.

<(a) Repeating Unit Represented by Formula (1)>

Formula (1)

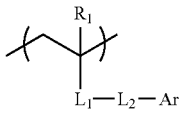

In Formula (1), $R_1$ represents a hydrogen atom, a methyl group or a halogen atom; $L_1$ represents *—COO—, *—COO—, *—$CONR_2$—, *—O— or a substituted or unsubstituted phenylene group; $R_2$ represents a hydrogen atom or an alkyl group having 1 to 10 carbon atoms; * represents a site to be bonded to a main chain; $L_2$ represents a single bond or a divalent linking group; and Ar represents a monovalent group derived from an aromatic ring.

In Formula (1), $R_1$ represents a hydrogen atom, a methyl group or a halogen atom, preferably a methyl group.

$L_1$ represents *—COO—, *—COO—, *—$CONR_2$—, *—O— or a substituted or unsubstituted phenylene group. When $L_1$ represents a phenylene group, the phenylene group is preferably unsubstituted. $R_2$ represents a hydrogen atom or an alkyl group having 1 to 10 carbon atoms.

$L_2$ represents a single bond or a divalent linking group. The divalent linking group is preferably a linking group having 1 to 30 carbon atoms, more preferably a linking group having 1 to 25 carbon atoms, further preferably a linking group having 1 to 20 carbon atoms, and particularly preferably a linking group having 1 to 15 carbon atoms.

Among these, most preferred are an alkyleneoxy group having 1 to 25 carbon atoms (more preferably 1 to 10 carbon atoms), an imino group (—NH—), a sulfamoyl group, and a divalent linking group including an alkylene group such as an alkylene group having 1 to 20 carbon atoms (more preferably 1 to 15 carbon atoms) or an ethylene oxide group [(—$(CH_2CH_2O)_n$)—, n=1 to 6], and a combination of two or more kinds of these groups.

Ar represents a monovalent group derived from an aromatic group.

The monovalent aromatic group represented by Ar is not particularly limited, but examples thereof include a benzene ring, a condensed aromatic ring having 8 or more carbon atoms, an aromatic ring condensed with a hetero ring, and an aromatic ring formed from two or more condensed benzene rings.

The condensed aromatic ring having 8 or more carbon atoms refers to an aromatic ring formed from at least two condensed benzene rings, i.e., an aromatic compound having 8 or more carbon atoms whose ring is formed from at least one kind of an aromatic ring and an alicyclic hydrocarbon condensed with the aromatic ring. Specific examples include naphthalene, anthracene, fluorene, phenanthrene and acenaphthene.

The aromatic condensed with a hetero ring refers to a compound formed from an aromatic compound not including a hetero atom (preferably a benzene ring) and a cyclic compound including a hetero atom. The cyclic compound including a hetero atom is preferably a five-membered or six-membered ring. The hetero atom is preferably a nitrogen atom, an oxygen atom or a sulfur atom. The cyclic compound including a hetero atom may have plural hetero atoms. In that case, the plural hetero atoms may be the same or different from each other.

Specific examples of the aromatic ring condensed with a hetero ring include phthalimide, acridone, carbazole, benzoxazole and benzothiazole.

Specific examples of the monomer that forms a repeating unit represented by Formula (1) include vinyl monomers such as (meth)acrylates, (meth)acrylamides, styrenes and vinyl esters.

In the invention, in a hydrophobic structural unit having an aromatic ring bonded to an atom that forms a main chain via a linking group, the aromatic ring is bonded to an atom that forms a main chain of a water-insoluble resin via a linking group, rather than being directly bonded to an atom that forms a main chain of a water-insoluble resin. As a result, an adequate distance between the hydrophobic aromatic ring and a hydrophilic structural unit is maintained, whereby interaction between the water-insoluble resin and the pigment is easily generated and dispersibility is further improved by strong adsorption.

Specific examples of a monomer that forms a repeating unit represented by Formula (1) include the following monomers. However, the invention is not limited to these examples.

M-25

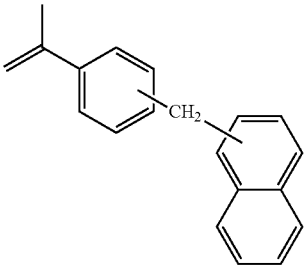

(meta or para-substitute)

M-27

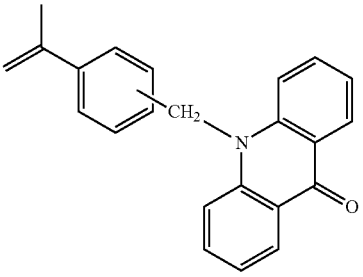

(meta or para-substitute)

M-28

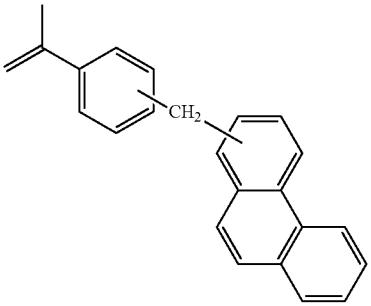

(meta or para-substitute)

M-29

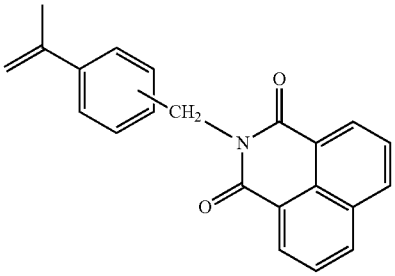

(meta or para-substitute)

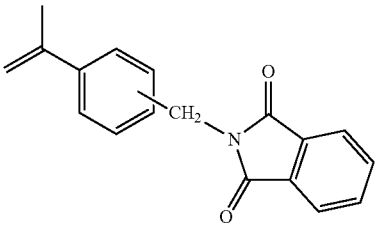

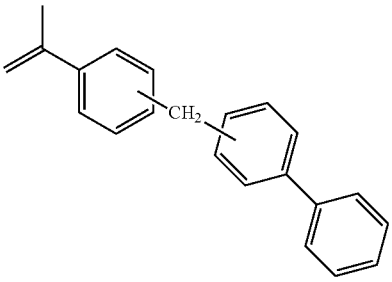

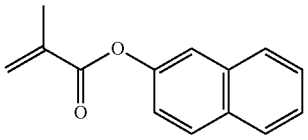

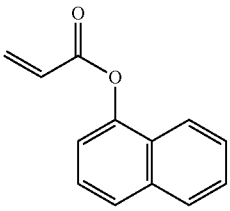

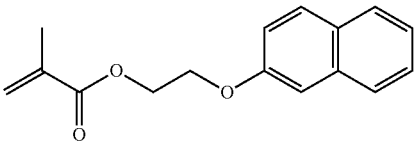

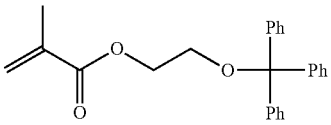

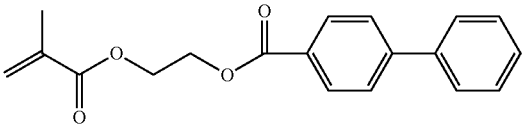

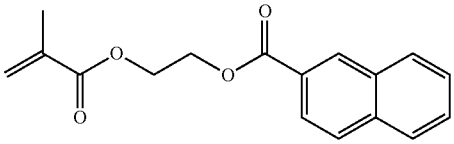

-continued
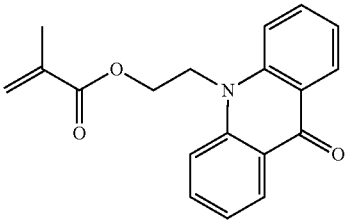
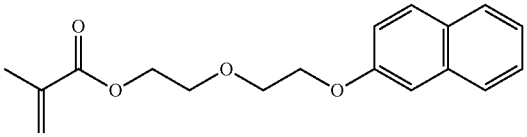
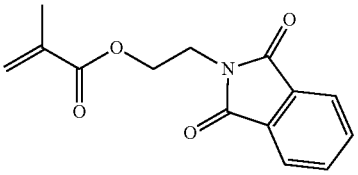
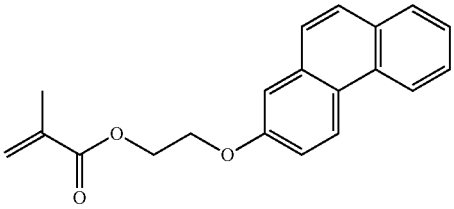
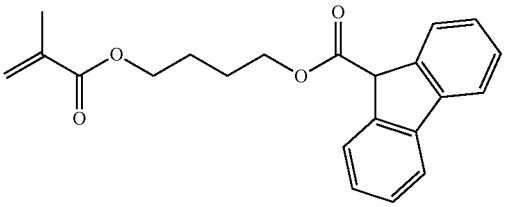
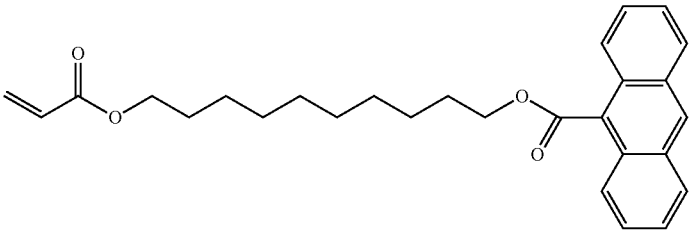
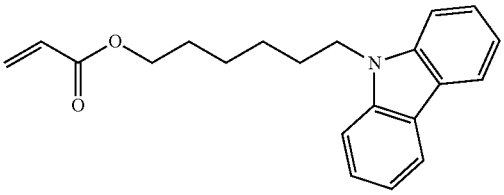
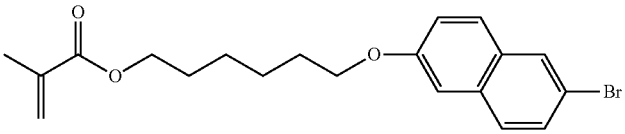
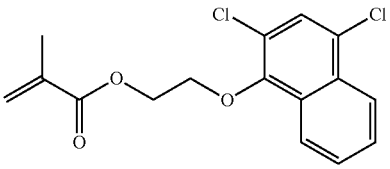
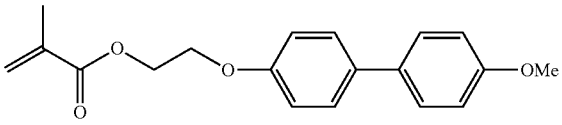
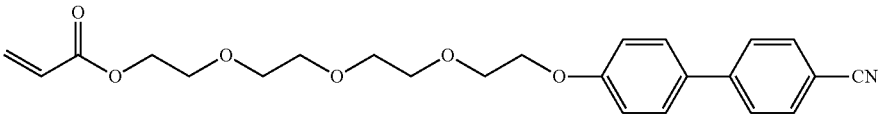
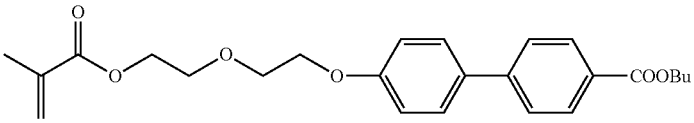
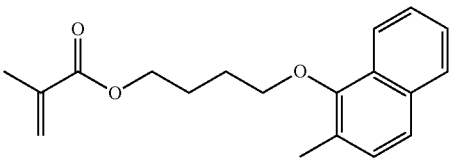
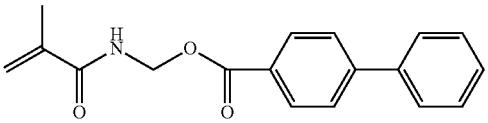
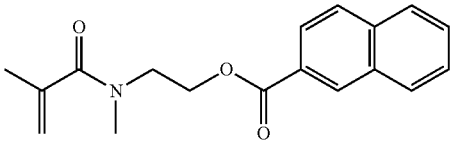

-continued

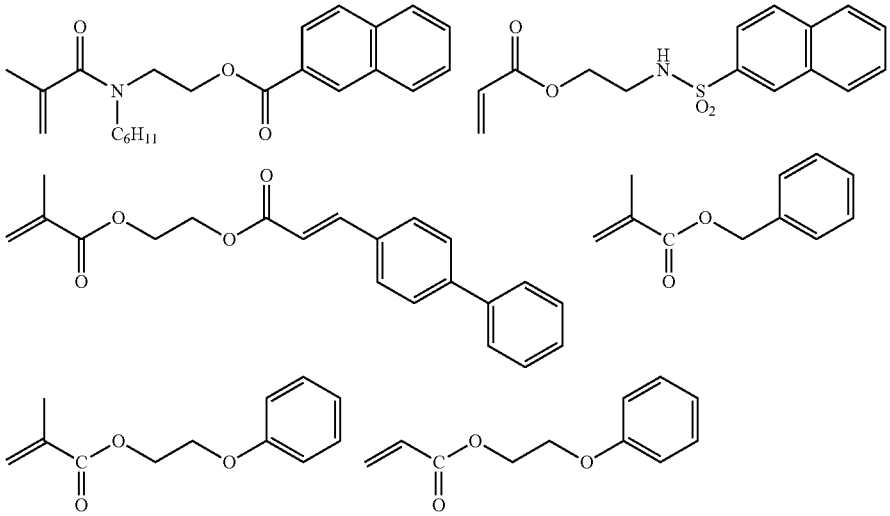

In the repeating unit (a) represented by Formula (1), Ar is preferably a monovalent group derived from benzyl (meth) acrylate, phenoxyethyl acrylate, phenoxyethyl methacrylate, acridone or phthalimide, from the viewpoint of dispersion stability of the coated pigment.

The repeating unit may be used alone or as a combination of two or more kinds.

The content ratio of the repeating unit represented by Formula (1) in the polymer with respect to the total mass of the polymer is preferably from 5% by mass to 25% by mass, more preferably from 10% by mass to 18% by mass. When the content ratio is 5% by mass or more, defects in images, such as white deletion, may be remarkably suppressed. When the content ratio is 25% by mass or less, problems in production suitability due to reduction in solubility in a polymerization reaction solution of the polymer (for example, methyl ethyl ketone) may be suppressed.

<Other Hydrophobic Repeating Units>

Polymer [1] may further include a hydrophobic repeating unit other than the repeating unit represented by Formula (1), as a hydrophobic structural unit. Such hydrophobic repeating units include, for example, those derived from vinyl monomers that do not belong to a hydrophilic structural unit (for example, a structural unit not having a hydrophilic functional group), such as (meth)acrylates, (meth)acrylamides, styrenes and vinyl esters, or those derived from a hydrophobic structural unit having an aromatic ring bonded to an atom that forms a main chain via a linking group. These structural units may be used alone or as a combination of two or more kinds.

Examples of (meth)acrylates include alkyl (meth)acrylates such as methyl (meth)acrylate, ethyl (meth)acrylate, butyl (meth)acrylate, isobutyl (meth)acrylate and hexyl (meth) acrylate. Among these, an alkyl ester of (meth)acrylic acid having 1 to 4 carbon atoms, preferably methyl (meth)acrylate, ethyl (meth)acrylate and butyl (meth)acrylate, particularly preferably methyl (meth)acrylate and ethyl (meth)acrylate.

Examples of the (meth)acrylamides include N-cyclohexyl (meth)acrylamide, N-(2-methoxyethyl) (meth)acrylamide, N,N-diallyl (meth)acrylamide and N-allyl (meth)acrylamide.

Examples of the styrenes include styrene, methyl styrene, dimethyl styrene, trimethyl styrene, ethyl styrene, isopropyl styrene, n-butyl styrene, tert-butyl styrene, methoxy styrene, butoxy styrene, acetoxy styrene, chloro styrene, dichloro styrene, bromo styrene, chloromethyl styrene, hydroxy styrene protected with a group that can be removed with an acidic substance (such as t-Boc), vinyl benzoic acid methyl ester, α-methyl styrene and vinyl naphthalene. Among these, styrene and α-methyl styrene are preferred.

Examples of the vinyl esters include vinyl acetate, vinyl chloro acetate, vinyl propionate, vinyl butyrate, vinyl methoxy acetate and vinyl benzoate. Among these, vinyl acetate is preferred.

<(b) Repeating Unit Having Ionic Group>

Examples of the repeating unit having an ionic group include a repeating unit derived from a monomer having an ionic group such as a carboxyl group, a sulfo group or a phosphonate group. Specific examples include vinyl monomers having an ionic functional group such as (meth)acrylic acid, (meth)acrylates and (meth)acrylamides. The repeating unit having an ionic group can be introduced into a polymer chain by polymerization of the corresponding monomer, but it is also possible to introduce an ionic group to a polymer chain after obtaining the same by polymerization.

Among these, a repeating unit derived from acrylic acid or methacrylic acid is preferred, and either one or both of a structural unit derived from acrylic acid or a structural unit derived from methacrylic acid are preferably included in the polymer chain.

Polymer [1] preferably include, with respect to the total mass of the polymer, 15% by mass or less of (b) a repeating unit having an ionic group, and at least include, as a repeating unit having an ionic group, a structural unit derived from (meth)acrylic acid.

When the content of (b) a repeating unit having an ionic group is 15% by mass or less with respect to the total mass of the polymer, the polymer exhibits favorable dispersion stability. In particular, from the viewpoint of dispersion stability, the content of (b) a repeating unit having an ionic group is preferably from 5% by mass to 15% by mass, more preferably from 7% by mass to 13% by mass.

Polymer [1] can exist stable in an aqueous ink composition, and alleviate the deposition or accumulation of coagulations at an inkjet head or the like, and exhibit excellent removability of the coagulations. From these viewpoints, polymer [1] may further include a hydrophobic structural unit other than (a) a repeating unit represented by Formula (1) or a hydrophilic structural unit other than (b) a repeating unit having an ionic group.

<Hydrophilic Repeating Unit>

Examples of the hydrophilic structural unit other than (b) a repeating unit having an ionic group include a repeating unit derived from a monomer having a nonionic hydrophilic group, and examples thereof include vinyl monomers having a hydrophilic functional group, such as (meth)acrylates having a hydrophilic functional group, (meth)acrylamides having a hydrophilic functional group, and vinyl esters having a hydrophilic functional group.

Examples of the hydrophilic functional group include a hydroxyl group, an amino group, an amido group (whose nitrogen atom is not substituted), and alkylene oxides such as polyethylene oxide and polypropylene oxide, which will be described later.

Examples of the monomer that forms a hydrophilic repeating unit having a nonionic hydrophilic group are not particularly limited and may be selected from known monomers, as long as the monomer has a functional group capable of forming a polymer, such as an ethylenically unsaturated bond, and a nonionic hydrophilic functional group. Specific examples include hydroxyethyl (meth)acrylate, hydroxybutyl (meth) acrylate, (meth)acrylamide, aminoethyl acrylate, aminopropyl acrylate, and (meth)acrylate containing an alkylene oxide polymer.

The hydrophilic repeating unit having a nonionic hydrophilic group can be formed by polymerization of the corresponding monomer, but it is also possible to introduce a hydrophilic functional group into a polymer chain that has been obtained by polymerization.

The hydrophilic repeating unit having a nonionic hydrophilic group is more preferably a hydrophilic structural unit having an alkylene oxide structure. The alkylene moiety of the alkylene oxide structure is, from the viewpoint of hydrophilicity, preferably an alkylene having 1 to 6 carbon atoms, more preferably an alkylene having 2 to 6 carbon atoms, and particularly preferably an alkylene having 2 to 4 carbon atoms. The polymerization degree of the alkylene oxide structure is preferably from 1 to 120, more preferably 1 to 60, and particularly preferably 1 to 30.

Other preferred embodiment of the hydrophilic repeating unit having a nonionic hydrophilic group is a hydrophilic repeating unit including a hydroxyl group. The number of hydroxyl groups in the repeating unit is not particularly limited, but preferably 1 to 4, more preferably 1 to 3, particularly preferably 1 or 2, from the viewpoint of hydrophilicity of a water-insoluble resin or compatibility with a solvent used for polymerization or other monomers.

The composition of a hydrophilic repeating unit and a hydrophobic repeating unit (including a repeating structure represented by Formula (1)) in polymer [1] depends on the degree of hydrophilicity or hydrophobicity of the repeating units, but the content of the hydrophilic repeating unit is preferably 15% by mass or less. In that case, the content of the hydrophobic repeating unit with respect to the total mass of the water-insoluble resin is preferably more than 80% by mass, more preferably 85% by mass or more.

When the content of the hydrophilic repeating unit is 15% by mass or less, the amount of the component that independently dissolves in an aqueous medium can be suppressed, properties such as dispersibility of the pigment can be improved, and favorable ink dischargeability during inkjet recording can be achieved.

The content ratio of the hydrophilic repeating unit with respect to the total mass of the water-insoluble resin is preferably from more than 0% by mass to 15% by mass or less, more preferably from 2% by mass to 15% by mass, yet more preferably from 5% by mass to 15% by mass, particularly preferably from 8% by mass to 12% by mass.

The content ratio of the aromatic ring in the water-insoluble resin with respect to the total mass of the water-insoluble resin is preferably 27% by mass or less, more preferably 25% by mass or less, yet more preferably 20% by mass or less. In particular, the content of the aromatic ring is preferably from 15% by mass to 20% by mass, more preferably from 17% by mass to 20% by mass. When the content ratio of the aromatic ring is within the range, abrasion resistance, can be improved.

The following are specific examples of polymer [1] (molar ratio (mass %), weight average molecular weight (Mw), acid value). However, the invention is not limited to these specific examples.

phenoxyethyl acrylate/methyl methacrylate/acrylic acid copolymer (50/45/5)

phenoxyethyl acrylate/benzyl methacrylate/isobutyl methacrylate/methacrylic acid copolymer (30/35/29/6)

phenoxyethyl methacrylate/isobutyl methacrylate/methacrylic acid copolymer (50/44/6)

phenoxyethyl acrylate/methyl methacrylate/ethyl acrylate/acrylic acid copolymer (30/55/10/5)

benzyl methacrylate/methyl methacrylate/methacrylic acid copolymer (60/30/10)

(M-25/M-27) mixture/ethyl methacrylate/methacrylic acid copolymer (molar ratio: 15/75/10, Mw: 49400, acid value: 65.2 mgKOH/g)

M-25/ethyl methacrylate/methacrylic acid copolymer (molar ratio: 18/69/13, Mw: 41600, acid value: 84.7 mgKOH/g)

(M-28/M-29) mixture/ethyl methacrylate/methacrylic acid copolymer (molar ratio: 15/85/10, Mw: 38600, acid value: 65.2 mgKOH/g)

(M-28)/ethyl methacrylate/methacrylic acid copolymer (molar ratio: 20/73/7, Mw: 45300, acid value: 45.6 mgKOH/g)

(Urea)

The image forming liquid according to the invention includes urea. If urea is included, when the liquid composition containing a colorant adheres to an inkjet head or the like and increases its viscosity to solidify, cleaning properties such as removability by wiping can be improved.

The content of urea in the image forming liquid with respect to the total mass of the image forming liquid is preferably from 1.0% by mass to 10.0% by mass, more preferably from 2.0% by mass to 8.0% by mass.

When the content of urea is 1.0% by mass or more, the liquid can be easily removed. For example, when an ink for inkjet recording is prepared, the ink adhering to an ejection head can be easily removed by wiping, whereby maintainability can be improved. In addition, since generation of an ammonia gas and carbon dioxide due to decomposition of urea or the like is increased, the effect of providing a first breakage portion having a certain level of small thickness (described later) is remarkable. Further, when the content of urea is 10.0% by mass or less, it is advantageous in terms of preventing an image from becoming tacky or preventing blocking, which may be caused by moisture absorption by urea or a derivative thereof included in the image.

(Water)

The image forming liquid according to the invention contains water and is prepared as an aqueous medium. The content of water is not particularly limited, but is preferably from 10% by mass to 99% by mass, more preferably from 30% by mass to 80% by mass, yet more preferably from 50% by mass to 70% by mass.

(Resin Particles)

The image forming liquid according to the invention may include particles of a water-insoluble resin. By including water-insoluble resin particles in the image forming liquid, in addition to the resin used for coating the pigment as described above, fixability of the image forming liquid to a recording medium or abrasion resistance of the image can be further improved.

When the image forming liquid (for example, an ink composition) includes resin particles, addition of urea can improve removability of the image forming liquid when it is dried and solidified, and the effect of the invention is further enhanced when the image forming liquid has the liquid composition as set forth above.

In the invention, water-insoluble resin refers to a polymer that dissolves, after being dried for 2 hours at 105° C., in 100 g of water at 25° C. in an amount of 10 g or less. From the viewpoint of improving consecutive dischargeability or discharge stability of the ink, the amount of resin dissolved in water is preferably 5 g or less, more preferably 1 g or less. The amount of the resin dissolved in water refers to an amount of the resin dissolved in water that is neutralized by 100% with sodium hydroxide or acetic acid, depending on the type of the salt forming group of the water-insoluble polymer.

Examples of the water-insoluble resin particles include particles of resin such as thermoplastic, thermosetting or modified acrylic resin, epoxy resin, polyurethane resin, polyether resin, polyamide resin, unsaturated polyester resin, phenol resin, silicone resin, fluorine resin, polyvinyl resin such as vinyl chloride, vinyl acetate, polyvinyl alcohol or polyvinyl butyral, polyester resin such as alkyd resin or phthalic acid resin, amino-based materials such as melamine resin, melamine formaldehyde resin, amino alkyd cocondensed resin and urea resin, and copolymers or mixtures of these resins. Among these, an anionic acrylic resin can be obtained by, for example, polymerizing an acrylic monomer having an anionic group (anionic group-containing acrylic monomer) and, as necessary, another monomer that can be copolymerized with the anionic group-containing acrylic monomer, in a solvent. Examples of the anionic group-containing acrylic monomer include an acrylic monomer having one or more functional groups selected from the group consisting of a carboxyl group, a sulfonic acid group and a phosphonic acid group. Among these, an acrylic monomer having a carboxyl group (for example, acrylic acid, methacrylic acid, crotonic acid, ethacrylic acid, propyl acrylic acid, isopropyl acrylic acid, itaconic acid and fumaric acid) is preferred, and acrylic acid or methacrylic acid is particularly preferred.

The water-insoluble resin particles are preferably self-dispersing resin particles, from the viewpoint of discharge stability and liquid stability of a system including a pigment (in particular, dispersion stability). The self-dispersing resin refers to a water-insoluble polymer that becomes, when it is dispersed by a phase transfer emulsification method in the absence of a surfactant, dispersed in an aqueous medium by a functional group of the polymer itself (in particular, an acidic group or a salt thereof).

The term "dispersed" refers to a state in which the water-insoluble polymer is dispersed in the form of a liquid in an aqueous medium (i.e., an emulsion), and a state in which the water-insoluble polymer is dispersed in the form of a solid in an aqueous medium (i.e., a suspension).

When the self-dispersing resin is included in an ink composition, from the viewpoint of ink fixability, the self-dispersing resin is preferably a self-dispersing resin that can be dispersed as a solid.

One method of obtaining a state of emulsification or dispersion of the self-dispersing resin, i.e., a method of preparing an aqueous dispersion of the self-dispersing resin, is a phase transfer emulsification method. One example of the phase transfer emulsification method is a method that includes adding a self-dispersing resin, which is dissolved or dispersed in a solvent (for example, water-soluble organic solvent), to water without adding a surfactant, and while neutralizing the salt-forming group of the self-dispersing resin (for example, an acidic group), stirring, mixing and removing the solvent, thereby obtaining an aqueous dispersion in a state of an emulsion or a suspension.

The state of stable emulsion or dispersion refers to a state in which the state exists stable at 25° C. at least for one week and precipitation is not visually observed in a mixture of a solution in which 30 g of the water-insoluble polymer is dissolved in 70 g of an organic solvent (for example, methyl ethyl ketone), a neutralizer that can neutralize the salt-forming group of the water-insoluble polymer by 100% (sodium hydroxide when the salt-forming group is anionic, and acetic acid when the salt-forming group is cationic) and 200 g of water, after being mixed and stirred (apparatus: stirrer having a stirring rotor, number of rotation: 200 rpm, 30 minutes, 25° C.) and the organic solvent is removed from the mixture.

The stability of the state of emulsion or dispersion of the self-dispersing resin may be evaluated also by an acceleration test of precipitation via centrifugal separation. The stability can be determined by an acceleration test of precipitation via centrifugal separation by, for example, adjusting the solid content concentration of the aqueous dispersion of resin particles obtained by the aforementioned method to 25% by mass, subjecting the dispersion to centrifugal separation for one hour at 12,000 rpm, and measuring the solid content concentration of the supernatant of the dispersion after being subjected to centrifugal separation.

The greater the ratio of the solid content concentration after centrifugal separation with respect to the solid content concentration before centrifugal separation is (the closer the ratio is to 1), the less likely the precipitation of resin particles is caused by centrifugal separation, i.e., the more stable the aqueous dispersion of resin particles is. In the invention, the ratio of solid content concentration before and after the centrifugal separation is preferably 0.8 or greater, more preferably 0.9 or greater, particularly preferably 0.95 or greater.

In the self-dispersing resin, the content of water-soluble components, which exhibit water solubility when the self-dispersing resin is dispersed, is preferably 10% by mass or less, more preferably 8% by mass or less, yet more preferably 6% by mass or less. When the content of water-soluble components is 10% by mass or less, swelling or fusion of resin particles can be effectively suppressed, and a more stable state of dispersion can be maintained. In addition, an increase in viscosity of the aqueous ink composition can be suppressed, and discharge stability can be further improved when the aqueous ink composition is used in an inkjet method, for example.

In the invention, the water-soluble component refers to a compound included in the self-dispersing resin that dissolves in water when the self-dispersing resin is dispersed. The water-soluble component is a water-soluble compound that is generated in the self-dispersing resin as a by-product, or mixed in the self-dispersing resin, during the production of the self-dispersing resin.

The main chain skeleton of the water-insoluble resin is not particularly limited, and examples include a vinyl polymer and a condensed polymer (such as epoxy resin, polyester, polyurethane, polyamide, cellulose, polyether, polyurea, polyimide or polycarbonate). Among these, a vinyl polymer is particularly preferred.

Preferred examples of the vinyl polymer and a monomer that constitutes the vinyl polymer include those described in JP-A No. 2001-181549 and JP-A No. 2002-88294. It is also possible to use a vinyl polymer in which a dissociable group is introduced to an distal end of a polymer chain, by radical polymerization of a vinyl monomer using a chain transfer agent, a polymerization initiator or an iniferter having a dissociable group (or a substituent group that can be induced to form a dissociable group), or by ion polymerization using a compound having a dissociable group (or a substituent group that can be induced to form a dissociable group) as an initiator or a terminator.

Preferred examples of the condensed polymer and a monomer that constitutes the condensed polymer include those described in JP-A No. 2001-247787.

From the viewpoint of self-dispersibility, the self-dispersing resin particles preferably contain a water-insoluble polymer that includes a hydrophilic structural unit and a structural unit derived from an aromatic group-containing monomer.

In the invention, the hydrophilic structural unit is not particularly limited as long as it is derived from a hydrophilic group-containing monomer, and may be derived from a single kind of hydrophilic group-containing monomer or from two or more kinds of hydrophilic group-containing monomers. The hydrophilic group is not particularly limited, and may be a dissociable group or a nonionic hydrophilic group. From the viewpoint of promoting self-dispersibility or forming a stable state of emulsion or dispersion, the hydrophilic group is preferably a dissociable group, more preferably an anionic dissociable group. Exemplary dissociable groups include a carboxyl group, a phosphoric acid group and a sulfonic acid group. Among these, from the viewpoint of fixability when the self-dispersing resin is used in an ink composition, a carboxyl group is preferred.

From the viewpoint of self-dispersibility and coagulability, the hydrophilic group-containing monomer is preferably a dissociable group-containing monomer, more preferably a dissociable group-containing monomer having a dissociable group and an ethylenically unsaturated bond. Exemplary dissociable group-containing monomers include an unsaturated carboxylic acid monomer, an unsaturated sulfonic acid monomer and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, 2-methahcryloyloxy methyl succinic acid.

Specific examples of the unsaturated sulfonic acid monomer include styrene sulfonic acid, 2-acrylamide-2-methyl propane sulfonic acid, 3-sulfopropyl (meth)acrylate and bis-(3-sulfopropyl)-itaconic acid ester.

Specific examples of the unsaturated phosphoric acid monomer include vinyl phosphonate, vinyl phosphate, bis (methacryloyloxyethyl) phosphate, diphenyl-2-acryloyloxyethyl phosphate, diphenyl-2-methacryloyloxyethyl phosphate and dibutyl-2-acryloyloxyethyl phosphate.

Among the dissociable group-containing monomers, from the viewpoint of dispersion stability and discharge stability, an unsaturated carboxylic acid monomer is preferred, an acrylic monomer is more preferred, and acrylic acid and methacrylic acid are particularly preferred.

From the viewpoint of self-dispersibility, the self-dispersing resin particles preferably include a polymer having a carboxyl group, more preferably a polymer having a carboxyl group and an acid value of from 25 to 100 mg/KOH/g. Further, from the viewpoint of self-dispersibility, the acid value is more preferably from 30 to 90 mg/KOH/g, particularly preferably from 35 to 65 mg/KOH/g. In particular, when the acid value is 25 mg/KOH/g or more, stability in self-dispersibility can be improved, and when the acid value is 100 mg/KOH/g or less, coagulability can be improved.

The aromatic group-containing monomer is not particularly limited, as long as it is a compound having an aromatic group and a polymerizable group. The aromatic group may be either a group derived from an aromatic hydrocarbon, or a group derived from an aromatic hetero ring. In the invention, from the viewpoint of stability in particle shape in an aqueous medium, the aromatic group is preferably a group derived from an aromatic hydrocarbon.

The polymerizable group may be either a condensation-polymerizable group or an addition-polymerizable group. In the invention, from the viewpoint of stability in particle shape in an aqueous medium, the polymerizable group is preferably an addition-polymerizable group, more preferably a group including an ethylenically unsaturated bond.

The aromatic group-containing monomer is preferably a monomer having an aromatic group derived from an aromatic hydrocarbon and an ethylenically unsaturated bond. The aromatic group-containing monomer may be used alone or as a combination of two or more kinds. Examples of the aromatic group-containing monomer include phenoxyethyl (meth) acrylate, benzyl (meth)acrylate, phenyl (meth)acrylate and styrene monomers. Among these, from the viewpoint of the balance between hydrophilicity and hydrophobicity of a polymer chain and ink fixability, an aromatic group-containing (meth)acrylate monomer is preferred, more preferably at least one kind selected from the group consisting of phenoxyethyl (meth)acrylate, benzyl (meth)acrylate and phenyl (meth)acrylate, yet more preferably phenoxyethyl (meth) acrylate and benzyl (meth)acrylate.

In the invention, (meth)acrylate refers to acrylate or methacrylate.

The self-dispersing resin is preferably an acrylic resin including a structural unit derived from a (meth)acrylate monomer, more preferably an acrylic resin including a structural unit derived from an aromatic group-containing (meth) acrylate monomer, further preferably an acrylic resin including from 10% by mass to 95% mass of a structural unit derived from an aromatic group-containing (meth)acrylate monomer. When the content of the aromatic group-containing (meth)acrylate monomer is from 10% by mass to 95% mass, stability in self-emulsification or stability in a state of dispersion can be improved, and further, an increase in ink viscosity can be suppressed.

From the viewpoint of stability in a state of self-dispersion, stability in particle shape in an aqueous medium due to hydrophobic interaction among aromatic rings, and a reduction in the amount of water-soluble components due to appropriate hydrophobization of the particles, the content of the aromatic group-containing (meth)acrylate monomer is preferably from 15% by mass to 90% by mass, more preferably from 15% by mass to 80% by mass, particularly preferably from 25% by mass to 70% by mass.

The monomer that forms another structural unit is not particularly limited, as long as it is a monomer that can copolymerize with an aromatic group-containing monomer and a dissociable group-containing monomer. Among these, from the viewpoint of flexibility of a polymer chain or ease of controlling the glass transition temperature (Tg), an alkyl group-containing monomer (for example, methyl (meth) acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate or ethylhexyl (meth)acrylate) is preferred.

The weight-average molecular weight of the water-insoluble polymer that forms the self-dispersing particles is preferably from 3,000 to 200,000, more preferably from 5,000 to 150,000, further preferably from 10,000 to 100,000. When the weight average molecular weight is 3,000 or more, the amount of water-soluble components can be effectively reduced. When the weight average molecular weight is 200,000 or less, stability in self-dispersibility can be improved.

The weight-average molecular weight can be measured by gel permeation chromatography (GPC). HLC-8020GPC (trade name, manufactured by Tosoh Corporation) is used as GPC, TSKgel Super HZM-H, TSKgel Super HZ4000, TSKgel SuperHZ200 (4.6 mmID×15 cm; trade names, all manufactured by Tosoh Corporation) are used as columns, and THF (tetrahydrofurane) is used as an eluent.

From the viewpoint of controlling hydrophilicity and hydrophobicity of the water-insoluble polymer that forms the self-dispersing resin particles, the water-insoluble polymer preferably includes a structural unit derived from an aromatic group-containing (meth)acrylate monomer (preferably a structural unit derived from phenoxyethyl (meth)acrylate and/or a structural unit derived from benzyl (meth)acrylate) in an amount of from 15 to 80% by mass with respect to the total mass of the self-dispersing resin particles, in terms of the copolymerization ratio.

Further, from the viewpoint of controlling hydrophilicity and hydrophobicity of the water-insoluble polymer, the water-insoluble polymer preferably includes from 15 to 80% by mass of a structural unit derived from an aromatic group-containing (meth)acrylate monomer in terms of the copolymerization ratio, and further includes a structural unit derived from a carboxyl group-containing monomer and a structural unit derived from an alkyl group-containing monomer (preferably a structural unit derived from an alkyl ester of (meth) acrylic acid). More preferably, the water-insoluble polymer preferably includes from 15 to 80% by mass of a structural unit derived from a phenoxyethyl (meth)acrylate and/or benzyl (meth)acrylate in terms of the copolymerization ratio and further includes a structural unit derived from a carboxyl group-containing monomer and a structural unit derived from an alkyl group-containing monomer (preferably a structural unit derived from an alkyl ester of (meth)acrylic acid having 1 to 4 carbon atoms).

The following are specific examples of the water-insoluble resin that forms the resin particles. However, the invention is not limited to these specific examples. The values described in the parentheses represent a mass ratio of the copolymerized components.

phenoxyethyl acrylate/methyl methacrylate/acrylic acid copolymer (50/45/5)

phenoxyethyl acrylate/benzyl methacrylate/isobutyl methacrylate/methacrylic acid copolymer (30/35/29/6)

phenoxyethyl methacrylate/isobutyl methacrylate/methacrylic acid copolymer (50/44/6)

phenoxyethyl acrylate/methyl methacrylate/ethyl acrylate/acrylic acid copolymer (30/55/10/5)

benzyl methacrylate/isobutyl methacrylate/methacrylic acid copolymer (35/59/6)

styrene/phenoxyethyl acrylate/methyl methacrylate/acrylic acid copolymer (10/50/35/5)

benzyl acrylate/methyl methacrylate/acrylic acid copolymer (55/40/5)

phenoxyethyl methacrylate/benzyl acrylate/methacrylic acid copolymer (45/47/8)

styrene/phenoxyethyl acrylate/butyl methacrylate/acrylic acid copolymer (5/48/40/7)

benzyl methacrylate/isobutyl methacrylate/cyclohexyl methacrylate/methacrylic acid copolymer (35/30/30/5)

phenoxyethyl acrylate/methyl methacrylate/butyl acrylate/methacrylic acid copolymer (12/50/30/8)

benzyl acrylate/isobutyl methacrylate/acrylic acid copolymer (93/2/5)

methyl methacrylate/methoxyethyl acrylate/benzyl methacrylate/acrylic acid copolymer (44/15/35/6)

styrene/butyl acrylate/acrylic acid copolymer (62/35/3)

methyl methacrylate/phenoxyethyl acrylate/acrylic acid copolymer (45/51/4)

The water-insoluble resin that forms the resin particles preferably includes a polymer synthesized in an organic solvent, the polymer having a carboxyl group and part or all of the carboxyl groups are neutralized, and is preferably prepared as a polymer dispersion in which water forms a continuous phase. More specifically, the water-insoluble resin particles are preferably produced by a method including a step of synthesizing a polymer in an organic solvent, and a step of dispersing the polymer to form an aqueous dispersion in which at least part or all of the carboxyl group of the polymer are neutralized.

The step of dispersing the polymer preferably includes the following steps (1) and (2).

Step (1): stirring a mixture containing a polymer (water-insoluble polymer), an organic solvent, a neutralizing agent and an aqueous medium.

Step (2): removing the organic solvent from the mixture.

Step (1) is preferably a process in which a dispersant is obtained by dissolving a polymer (water-insoluble polymer) in an organic solvent, and then mixing and stirring the same while gradually adding a neutralizing agent and an aqueous medium. By adding a neutralizing agent and an aqueous medium to a solution in which a water-insoluble polymer is dissolved in an organic solvent, self-dispersing resin particles having a particle diameter that achieves improved storage stability can be obtained without applying a strong shear force. The method of stirring the mixture is not particularly limited, and a mixer that is commonly used, or as necessary, a disperser such as an ultrasonic disperser or a high-pressure homogenizer may be used.

In step (2), an aqueous dispersion of self-dispersing resin particles is obtained by turning the mixture into an aqueous phase by distilling away the organic solvent by an ordinary method, such as reduced-pressure distillation. The organic solvent is substantially removed from the obtained aqueous dispersion, and the amount of the organic solvent is preferably 0.2% by mass or less, more preferably 0.1% by mass or less.

The content of the resin particles in an image forming liquid (for example, an ink composition) is preferably from 0.5 to 10% mass, more preferably from 1 to 9% by mass, with respect to the total mass of the image forming liquid. When the content of the resin particles is 0.5% by mass or more, abrasion resistance of the obtained image can be improved. When the content of the resin particles is 10% by mass or less, it is advantageous in terms of ejection stability over a long time, when the image forming liquid is prepared as an ink composition.

(Other Components)

When an ink composition for inkjet recording is prepared from the image forming liquid according to the invention, it may contain other components such as an additive as necessary, in addition to the components as described above. Examples of the other components include a color fading inhibitor, an emulsion stabilizer, a permeation promoter, a UV absorber, an antiseptic agent, an antifungal agent, a pH adjuster, a surface tension adjuster, an antifoaming agent, a viscosity adjuster, a dispersant, a dispersion stabilizer, an antirust agent and a chelating agent. These additives may be added directly to the ink composition after the preparation of the same, or may be added during the preparation thereof. Specific examples of the additives are described in paragraphs [0153] to [0162] of JP-A No. 2007-100071.

The pH of the image forming liquid (for example, an ink composition for inkjet recording) is adjusted to be 7.5 pH or more. When the pH is below 7.5, removability of the liquid may be poor, and it may be difficult to cause decomposition of urea in the liquid to generate a gas. When the pH is 7.5 or more, it becomes easier to cause decomposition of urea or the like to generate an ammonia gas or carbon dioxide due to a relatively high temperature environment or a long-term storage. As a result, deformation of a container may occur due to expansion thereof or the like, thereby causing collapse or breakage of the containers when stacked.

The pH is preferably 8.0 or more from the viewpoint of ease of generating a gas due to decomposition of urea or the like, and stability of the image forming liquid. The upper limit of the pH is preferably 10.0, more preferably 9.5, in consideration of adverse effects to members used in an inkjet head.

The pH described in the present specification is measured with a pH measurement device (for example, pH meter D-50, manufactured by Horiba, Ltd.) at 25° C. The adjustment of the pH can be carried out appropriately by using an acidic compound or a basic compound. The acidic compound or the basic compound is not particularly limited, and a typically used compound (such as sulfuric acid or sodium hydroxide) may be used.

<Image Forming Liquid Cartridge and Image Forming Apparatus>

In the following, the image forming liquid cartridge and the image forming apparatus according to the invention are described with reference to the drawing. In the drawings, members (components) having the same or corresponding functions are indicated by the same reference numbers, and overlapping explanations may be omitted.

—Entire Structure—

FIG. 1 is a schematic view showing the entire structure of an inkjet recording apparatus including the image forming liquid cartridge according to an exemplary embodiment of the invention.

As shown in FIG. 1, inkjet recording apparatus 1 includes recording media storage 12 in which recording medium P, such as printing paper, is stored; image recording section 14 in which an image is recorded to recording medium P; delivery unit 16 that delivers recording medium P from recording media storage 12 to image recording section 14; and recording medium ejection section 18 from which recording medium P to which the image has been recorded at image recording section 14 is ejected.

Image recording section 14 has ink droplet ejectors 10Y, 10M, 10C and 10K from which ink droplets are ejected to record an image onto a recording medium (hereinafter, referred to as inkjet heads), as an example of liquid droplet ejection head that ejects liquid droplets. Inkjet heads 10Y, 10M, 10C and 10K may be collectively referred to as inkjet heads 10Y to 10K.

Inkjet heads 10Y to 10K have nozzle surfaces 22Y to 22K having nozzles (not shown), respectively. Nozzle surfaces 22Y to 22K have a recordable region having a width that is equal to or greater than the maximum width of recording medium P to which an image is intended to be recorded.

Further, inkjet heads 10Y to 10K are arranged in parallel in the order of yellow (Y), magenta (M), cyan (C) and black (K), from the downstream side of a direction in which recording medium P is delivered, and an image is recorded by ejecting ink droplets corresponding to each color from plural nozzles by a piezoelectric method. In inkjet heads 10Y to 10K, the ink droplets may be ejected by other methods, such as a thermal method.

Inkjet recording apparatus 1 includes, as a storage portion in which a liquid is stored, main ink tanks 21Y, 21M, 21C and 21K (hereinafter, referred to as 21Y to 21K) that store inks of the corresponding colors. The inks are supplied from main ink tanks 21Y to 21K to inkjet heads 10Y to 10K. Various kinds of inks, such as aqueous ink, oil-based ink, solvent-based ink, may be used as inks supplied to inkjet heads 10Y to 10K.

Delivery unit 16 includes pick up drum 24 that picks up recording media P stored in recording medium storage 12 one by one; delivery drum 26 that delivers recording medium P to inkjet heads 10Y to 10K such that the recording surface (front surface) of recording medium P faces inkjet heads 10Y to 10K; and discharge drum 28 that discharges recording medium P to which an image has been formed to recording medium ejection section 18. Pick up drum 24, delivery drum 26 and discharge drum 28 are adapted to hold recording medium P at the circumference thereof by an electrostatic adsorption means or a non-electrostatic adsorption means such as a suction power or an adhesive power.

Pick up drum 24, delivery drum 26 and discharge drum 28 have grippers 30 (for example, two grippers each) that hold recording medium P by gripping the same at its downstream end in a delivery direction. The three drums 24, 26 and 28 are adapted to hold recording medium P (up to two recording media in this case) at the circumference thereof by grippers 30. Grippers 30 are provided in concave portions 24A, 26A and 28A, which are formed by the number of two at the circumference of drums 24, 26 and 28, respectively.

Specifically, rotation axis 34 is supported along rotation axis 32 of each of drums 24, 26 and 28, at predetermined positions of concave portions of drums 24, 26 and 28; and plural grippers 30 are fixed to rotation axis 34 in an axis direction while leaving a distance therebetween. As a result, when rotation axis 34 is rotated in both back and forth directions by an actuator (not shown), grippers 30 are rotated in both back and forth directions along a circumferential direction of drums 24, 26 and 28, whereby recording medium P is held by grippers 30 at its downstream end in a delivery direction, or is released by grippers 30.

More specifically, grippers 30 are rotated such that the tips thereof slightly protrude from the surface of drums 24, 26 and 28. At transfer position 36 at which the surface of pick up drum 24 and the surface of delivery drum 26 face each other, recording medium P is transferred from gripper 30 of pick up drum 24 to gripper 30 of delivery drum 26. At transfer position 38 at which the surface of delivery drum 26 and the surface of discharge drum 28 face each other, recording medium P is transferred from gripper 30 of delivery drum 26 to gripper 30 of discharge drum 28.

Inkjet recording apparatus 1 further includes a maintenance unit (not shown) that does maintenance of inkjet heads 10Y to 10K. The maintenance unit includes a cap that covers a nozzle surface of inkjet heads 10Y to 10K, a receiver that receives liquid droplets discharged by preliminary ejection (purging), a cleaning member that cleans the nozzle surface, a suction unit that suctions ink in the nozzle, and the like. The maintenance unit moves to a position at which the maintenance unit faces inkjet heads 10Y to 10K, and does maintenance of various kinds. A cleaning solution, which will be described later, is supplied to the maintenance unit.

In the following, the image recording operation of inkjet recording apparatus 1 is described.

Recording medium P that has been picked up from image recording storage 12 in a one-by-one manner by gripper 30 of pick up drum 24 is delivered while being adsorbed to the surface of pick up drum 24, and at transfer position 36, recording medium P is transferred from gripper 30 of pick up drum 24 to gripper 30 of delivery drum 26.

While being adsorbed to the surface of delivery drum 26, recording medium P being held by gripper 30 of delivery drum 26 is delivered to an image recording position of inkjet heads 10Y to 10K. At the image recording position, an image is recorded on a recording surface of recording medium P with ink droplets discharged from inkjet heads 10Y to 10K.

At transfer position 38, recording medium P on which the image has been recorded is transferred from gripper 30 of delivery drum 26 to gripper 30 of discharge drum 28. While being adsorbed to the surface of discharge drum 28, recording medium P being held by gripper 30 of discharge drum 28 is ejected to recording medium ejection section 18. The image recording operation is carried out through the processes as set forth above.

Liquid supply unit 40 is connected to main ink tanks 21Y to 21K. Liquid supply unit 40 supplies ink or a cleaning solution to main ink tanks 21Y to 21K or to the maintenance unit.

—Liquid Supply Unit—

Figure 2:
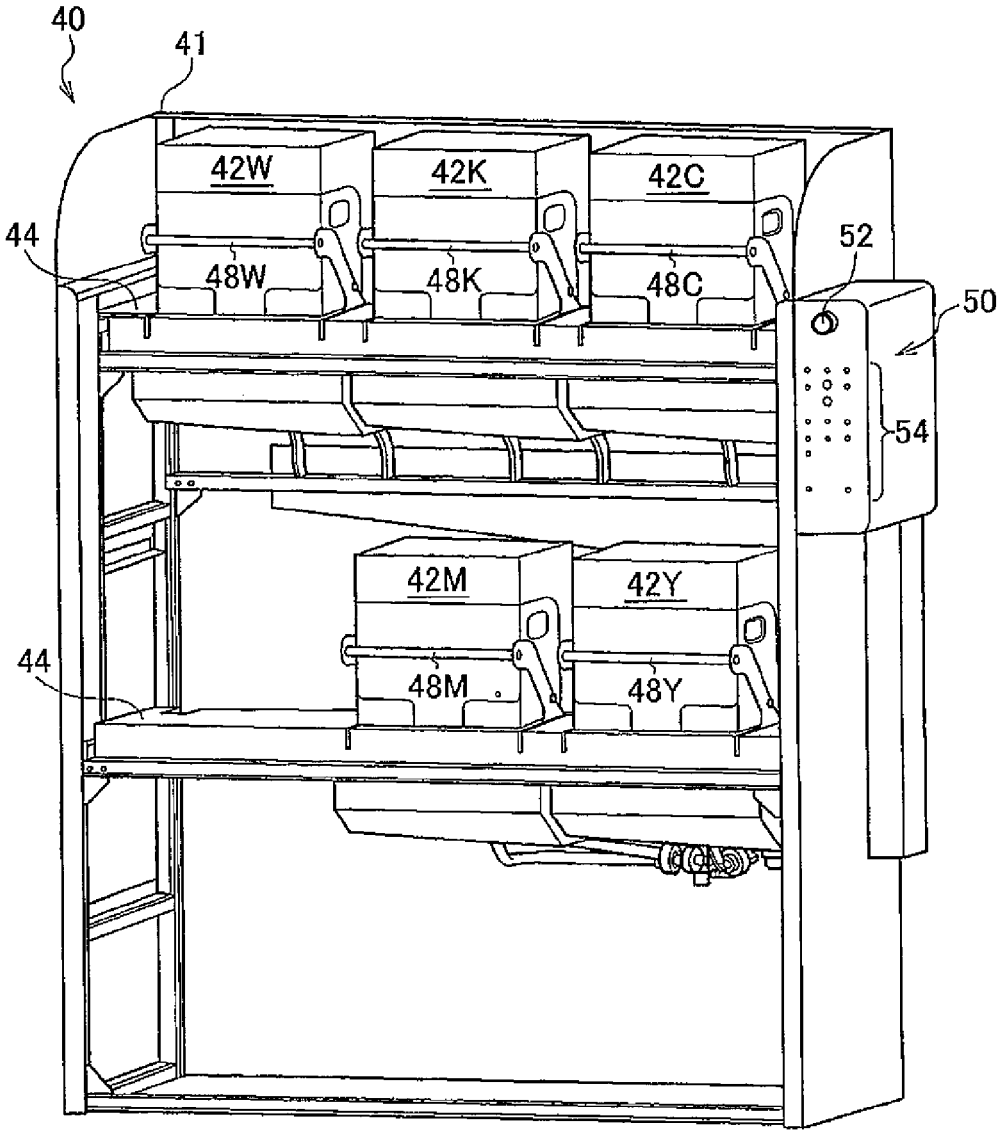
FIG. 2 is a side perspective view of the entire body of a liquid supply unit.

FIG. 2 is a front perspective view of the entire body of liquid supply unit 40.

Liquid supply unit 40 includes case 41 having three shelves and five tank units 42Y, 42M, 42C, 42K and 42W provided to case 41. Tank units 42Y, 42M, 42C, 42K and 42W may be collectively referred to as tank units 42Y to 42W. Tank units 42Y to 42W have an approximately cubic shape, respectively.

Tank units 42Y, 42M, 42C and 42K contain inks of yellow, magenta, cyan and black, respectively, and tank unit 42W contains a cleaning solution. Tank units 42Y to 42W can be detachably attachable to base 44 of case 41, and are replacement supply tanks for supplying a liquid.

On middle-shelf base 44 of case 41, tank unit 42Y and tank unit 42M are provided. On top-shelf base 44 of case 41, tank unit 42C, tank unit 42K and tank unit 42W are provided. Tank units 42Y to 42K are connected to main ink tanks 21Y to 21K via a pipe, respectively, and tank unit 42W is connected to the maintenance unit via a pipe.

Each of tank units 42Y to 42W are provided at a higher position in a gravitational direction than main ink tanks 21Y to 21K or the maintenance unit to which tank units 42Y to 42W are connected (to supply liquids), such that inks or a cleaning solution is supplied by means of the water head difference.

To base 44 of case 41, operation levers 48Y, 48M, 48C, 48K and 48W, each corresponding to tank units 42Y to 42W, are provided. Operation levers 48Y, 48M, 48C, 48K and 48W are operated up and down by an operator at the time of replacing tank units 42Y to 42W with new tank units.

Operation board 50 is provided at approximately an upper-right position of case 41. Operation board 50 includes operation switch 52 and plural indication lamps 54. When the amount of the ink in any one of main ink tanks 21Y to 21K or the amount of the cleaning solution in the maintenance unit decreases to a predetermined level, the corresponding indication lamp 54 lights to notify the operator of the time for replacing tank units 42Y to 42W.

In the following, since the configuration of tank units 42Y to 42W and the configuration of operation levers 48Y to 48W are the same, only tank unit 42Y and operation level 48Y will be specifically explained, and the character Y may be omitted sometimes.

Figure 3A:
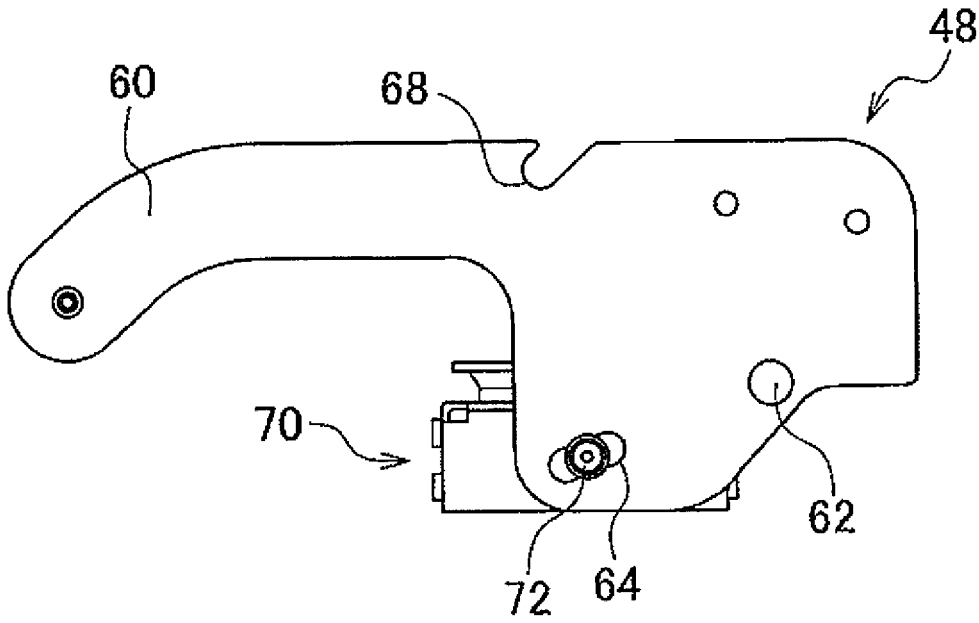
FIG. 3A is a side view of the inside of a base shown in FIG. 2, primarily illustrating an operation lever when it is positioned downward.
Figure 3B:
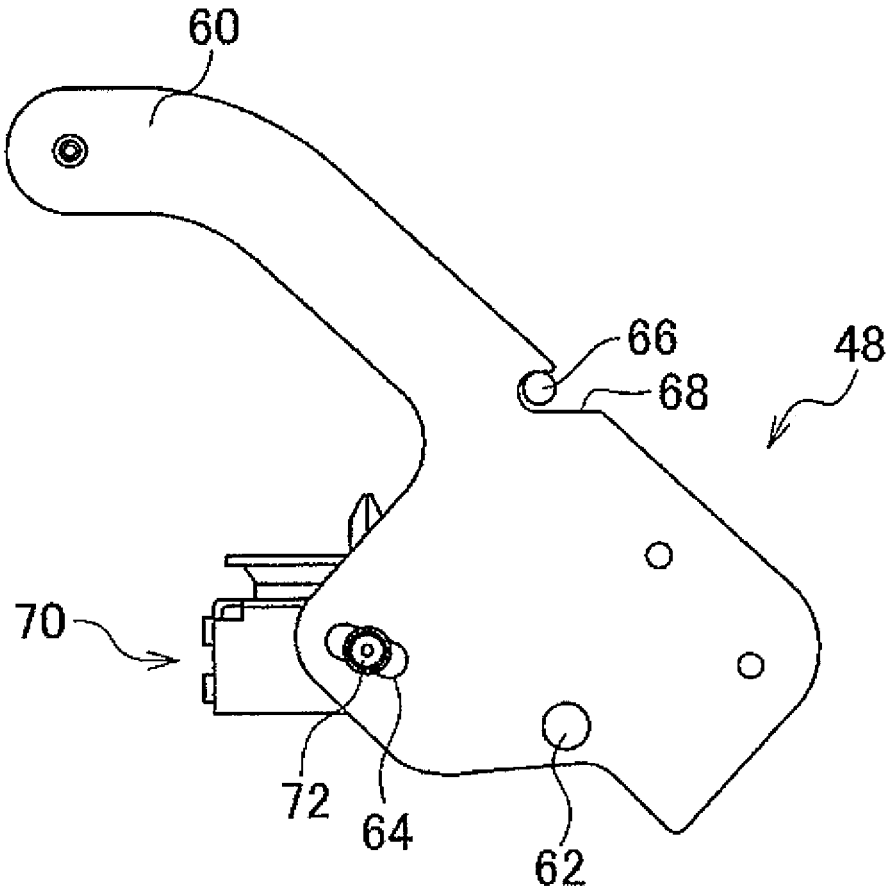
FIG. 3B is a side view of the inside of a base shown in FIG. 2, primarily illustrating an operation lever when it is positioned upward.

FIGS. 3A and 3B are side views of operation lever 48 inside base 44 shown in FIG. 2. FIG. 3A shows a state in which operation lever 48 is at a lower position, and FIG. 3B shows a state in which operation lever 48 is at an upper position.

Operation lever 48 has two lever arms 60 (one is not shown). Each of lever arms 60 is supported by base 44 via rotation axis 62, and operation lever 48 can be operated to rotate around rotation axis 62. Oval hole 64 and notch 68, at which lever arm 60 is engaged with the later-described engagement pin 66, are formed in lever arm 60. Notch 68 is formed along the circumference with rotation axis 62 as the center, and inhibits detachment of tank unit 42 when notch 68 is engaged with engagement pin 66.

Operation lever 48 is connected with punch member 70 that is positioned inside base 44 and opposite tank unit 42. Punch member 70 can be moved up and down according to the operation position of operation lever 48. Specifically, punch member 70 is positioned between lever arms 60, and connected to operation lever 48 by engaging side end pins 72, provided at both ends of punch member 70, with oval holes 64 formed in lever arms 60. Punch member 70 can be moved up and down according to the rotational operation of operation level 48, along two gate-shaped guide members (not shown) provided to the side surfaces of punch member 70.

As will be described later, when punch member 70 is moved upward by operation lever 48, punch member 70 is inserted into tank unit 42, and tank unit 42 is opened by punch member 70. As a result, a liquid (ink) is discharged from tank unit 42.

Figure 4:
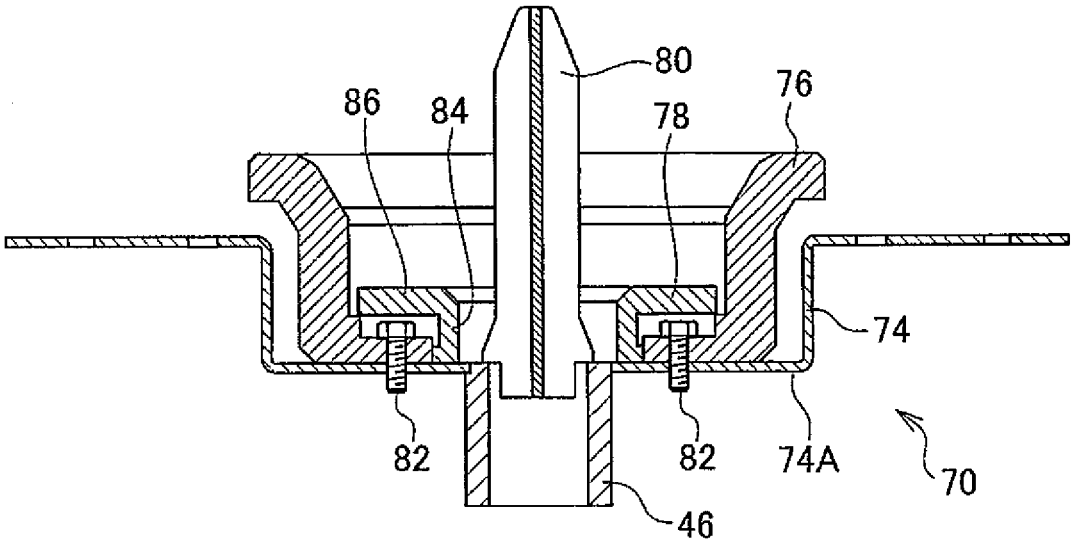
FIG. 4 is a sectional view of a punch member.

FIG. 4 is a cross-sectional view showing the structure of punch member 70.

Punch member 70 includes base member 74; surrounding member 76 that is provided in concave portion 74A of base member 74, and having an opening at its upper side and surrounding the opening; receiving member 78 provided inside surrounding member 76; and punch member 80 positioned inside receiving member 78.

Surrounding member 76 is fixed to base member 74 with screws 82. A hole is formed in advance at the center of the bottom surface of surrounding member 76. A hole smaller than the hole formed in surrounding member 76 is also formed in advance at the center of the bottom surface of concave portion 74A of base member 74.

Receiving member 78 is formed from a rubber material and has an approximately tubular shape, and is provided with a tube portion 84 and a receiving unit 86 that extends outward from an end of tube portion 84. The other end of tube portion 84 is closely attached to the bottom of concave portion 74A of base member 74, and receiving member 86 is closely attached to the bottom of surrounding member 76. To the hole formed in concave portion 74A of base member 74, one end of pipe 46, which connects the supply destination of the liquid, is attached. The base portion of punch member 80 is attached to an edge surface of pipe 46, and punch member 80 is fixed with its tip being positioned upward.

Figure 5A:
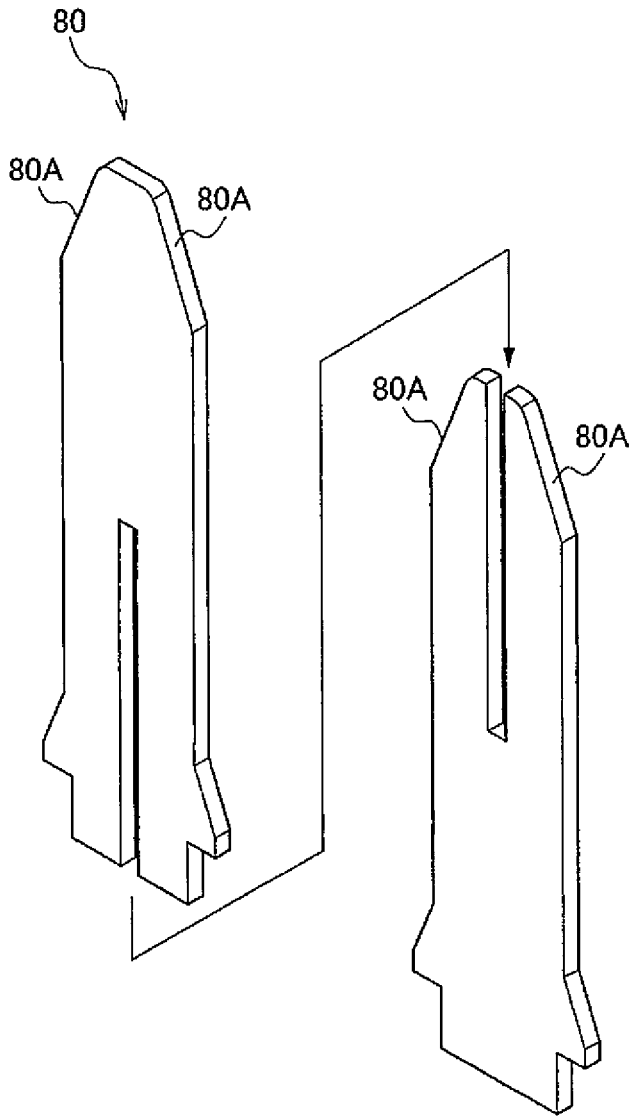
FIG. 5A is an exploded view of a punch member.
Figure 5B:
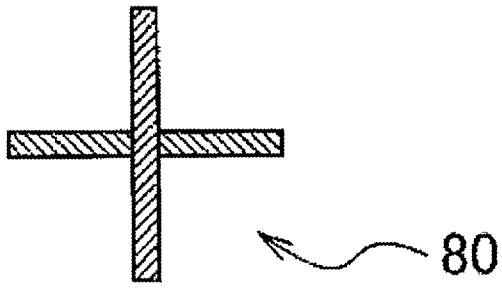
FIG. 5B is a sectional view of a punch member.

FIG. 5A and FIG. 5B are structural views showing the specific configuration of punch member 80. FIG. 5A is an exploded view of punch member 80, and FIG. 5B is a cross sectional view of punch member 80.

Punch member 80 is formed by interlocking two plates in an orthogonal manner. Specifically, one of the two plates has a groove that extends from the base portion thereof, while the other plate has a groove that extends from the top portion thereof, and punch member 80 is formed by inserting the one plate into the groove of the other plate. After interlocking the plates, the plates are fixed by welding or with an adhesive etc. As shown in FIG. 5A, slope portions 80A, which are sloped toward the center of the tip of punch member 80, are formed at the top portion of punch member 80. The section of punch member 80 has a radial shape, more specifically a crossed shape. Accordingly, the entire body of punch member 80 has the shape of a needle having a crossed section.

When punch member 80 is moved upward by operation lever 48, punch member 80 is inserted into tank unit 42.

—Carton Unit—

Figure 6:
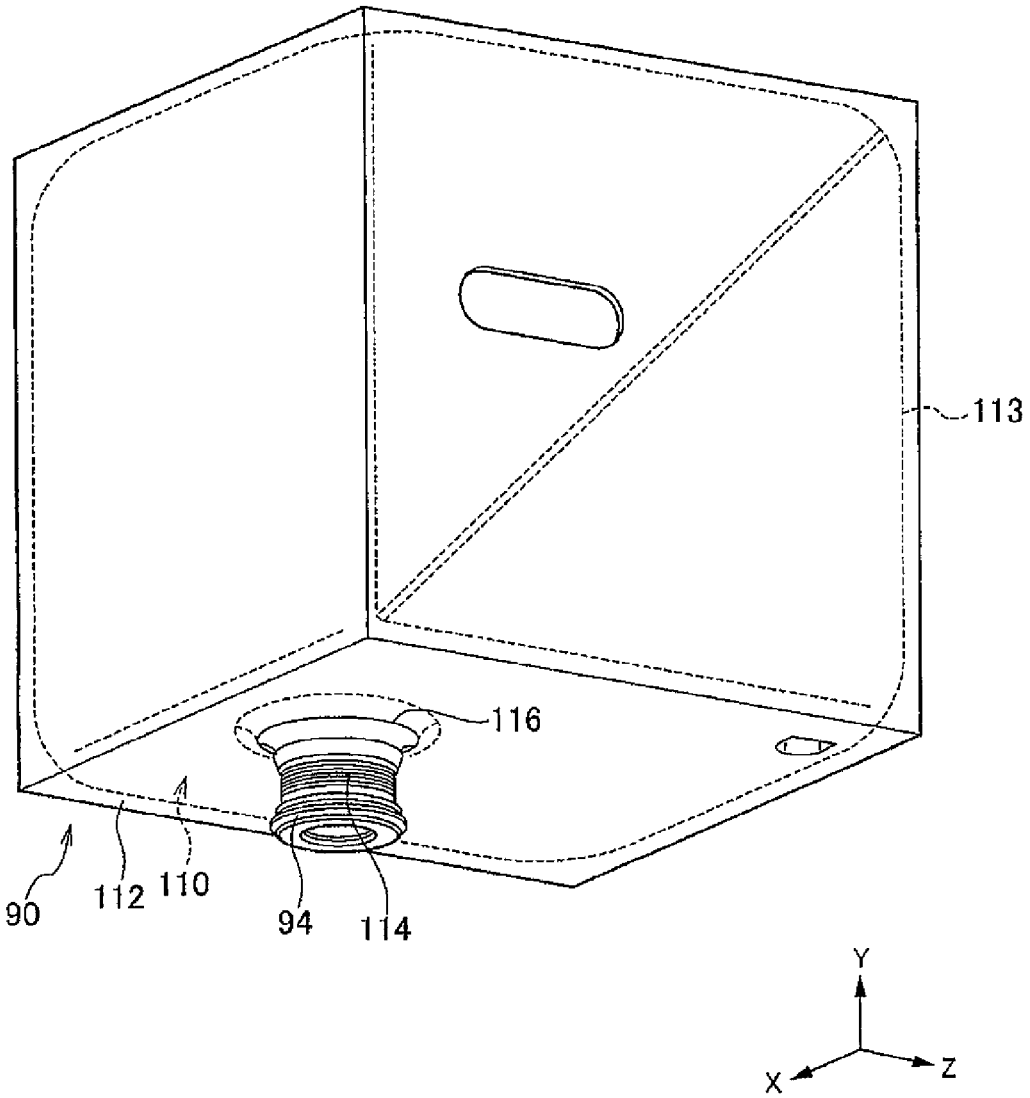
FIG. 6 is a side perspective view of an ink cartridge.

In the following, carton unit 90 will be explained. FIG. 6 is a front perspective view of the configuration of carton unit 90.

Carton unit 90 has an approximately cubic shape. Carton unit 90 is formed from the image forming liquid cartridge 110 according to the present exemplary embodiment, and carton (paper box) 112 that accommodates liquid container 113 of the cartridge.

Image forming liquid cartridge 110 includes liquid container 113 and cap portion 94. Liquid container 113 has flexibility and an approximately cubic shape, formed from polyethylene or the like, and contains a liquid (ink). Liquid container 113 has an opening portion 114 from which a liquid is supplied. Opening portion 114 is connected to cap portion 94, and carton 112 has opening 116 from which cap portion 14 is exposed.

The reason why liquid container 113 is attached to carton adaptor (not shown) while being accommodated in carton 112 is that it is easier to handle liquid container 133 than handling the same alone, and it is easier to attach liquid container 113 to carton adaptor.

Liquid container 113 does not have air vents or the like other than cap portion 94, and is squashed as the liquid is discharged from liquid container 113.

Figure 7:
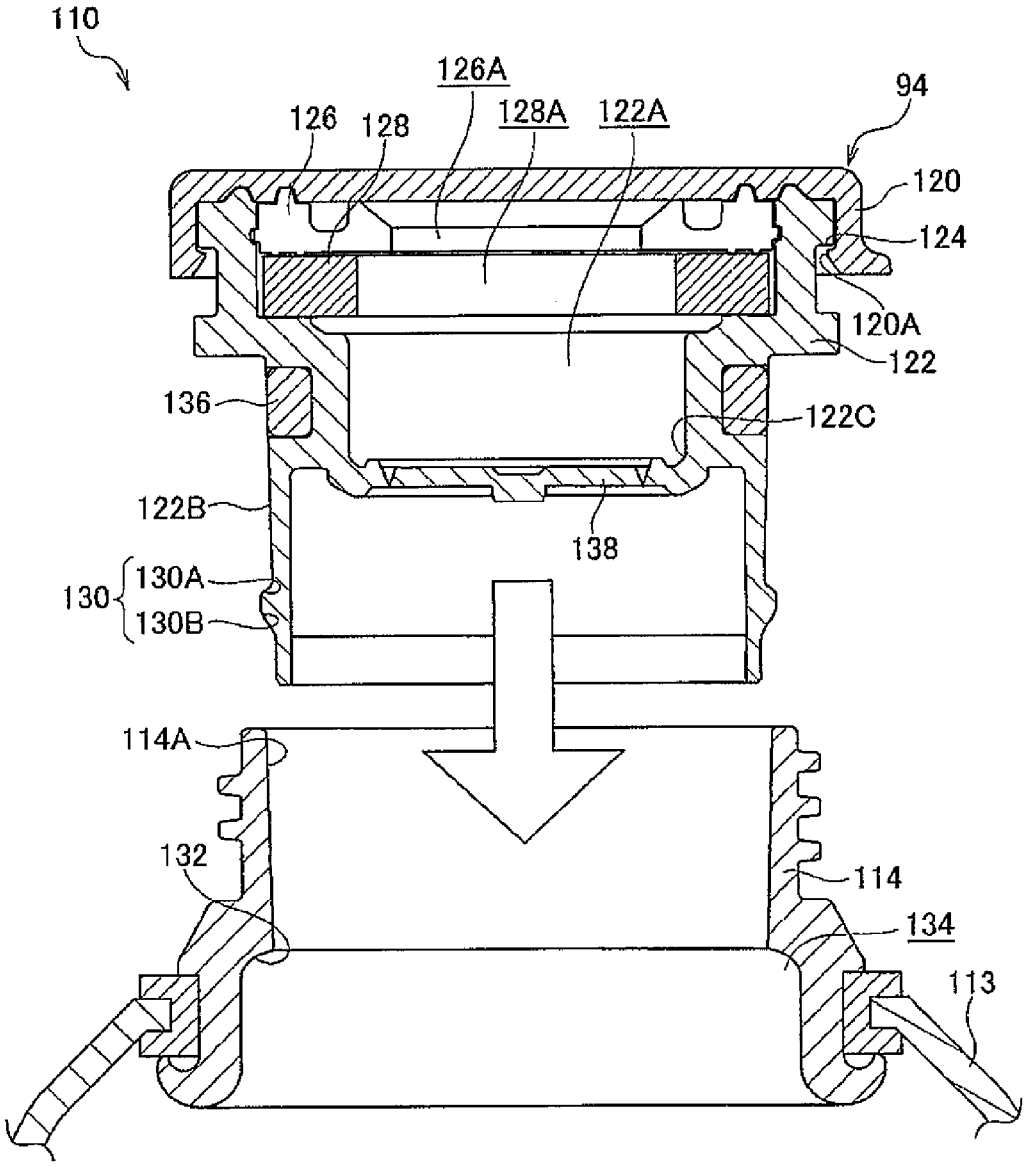
FIG. 7 is a sectional view of a cap portion of an image forming liquid cartridge according to an exemplary embodiment of the invention, before attaching the cap portion to an opening portion.

FIG. 7 is a cross-sectional view showing the configuration of cap portion 94 of the image forming liquid cartridge 110 according to the present exemplary embodiment, prior to being attached to opening portion 114.

Figure 8:
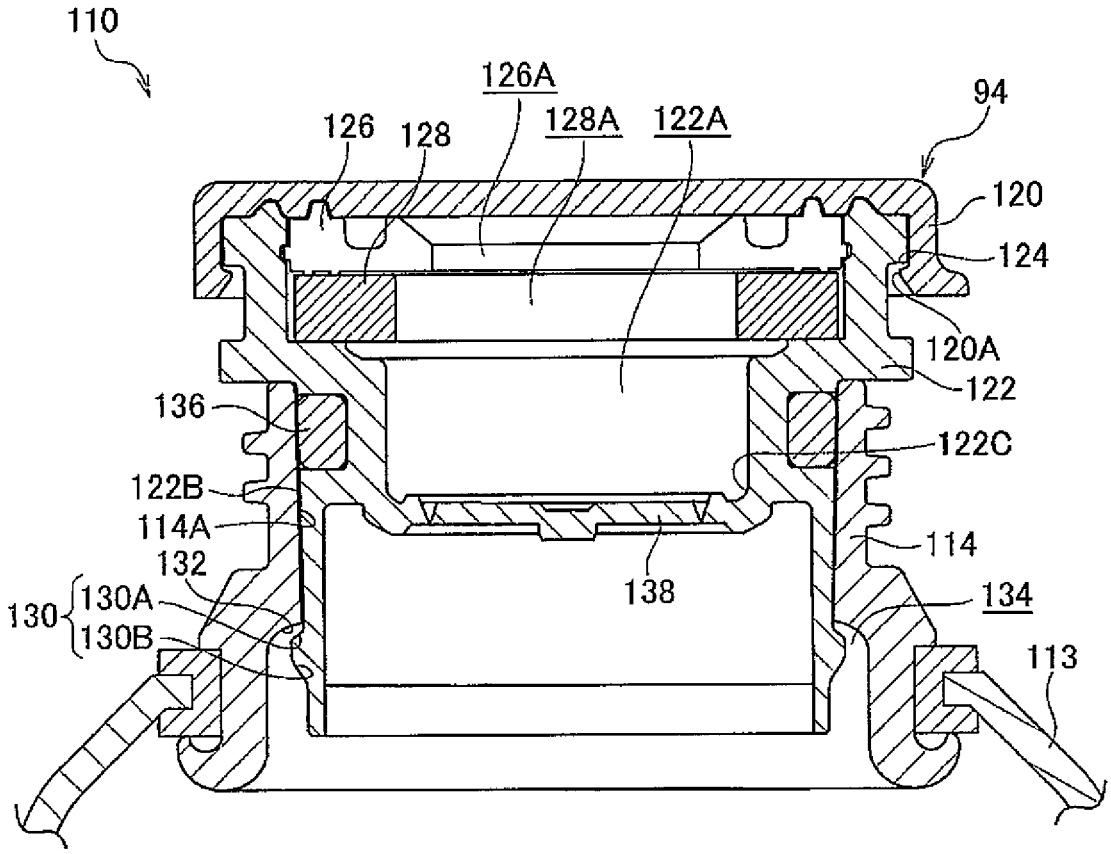
FIG. 8 is a sectional view of a cap portion of an image forming liquid cartridge according to an exemplary embodiment of the invention, after attaching the cap portion to an opening portion.

FIG. 8 is a cross-sectional view showing the configuration of cap portion 94, after being attached to opening portion 114.

Cap portion 94 is attached to opening portion 114 of liquid container 113 filled with ink. Cap portion 94 is made of a resin material, and is mainly formed of dust-proof cap 120 and cap body 122.

Dust-proof cap 120 is attached to an outer tip of cap body 122, and prevents dusts or the like from entering cap body 122 during transportation or storage of carton unit 90. Accordingly, dust-proof cap 120 is detached from cap body 122 when carton unit 90 is used. Further, dust-proof cap 120 has a claw portion 120A, and detachment of dust-proof cap 120 from cap body 122 is prevented by engaging claw portion 120A with engage portion 124 formed in cap body 122.

There are holding plate 126 that holds dust-proof cap 120, and supporting plate 128 that supports dust-proof cap 120, between an inner wall of dust-proof cap 120 and an inner wall 122C of cap body 122.

Holding plate 126 has a cylindrical shape, and penetration portion 126A, which penetrates holding plate 126, is formed at the center thereof. Supporting plate 128 is supported by inner wall 122C of cap body 122 and also has a cylindrical shape, and opening 128A that penetrates holding plate 128 to communicate with penetration portion 126A is formed at the center of supporting plate 128.

Cap body 122 also has a cylindrical shape, and penetration portion 122A that penetrates cap body 122 is formed at the center thereof. Claw portion 130 is formed as a protrusion at outer wall 122B at a tip of the inner wall of cap body 122 (liquid container 113 side). When cap body 122 is attached to opening portion 114 of liquid container 113, claw portion 130 is engaged with engage portion 132 formed at inner wall 114A of opening portion 114. Claw portion 130 includes first slope portion 130A and second slope portion 130B. Second slope portion 130B has a greater angle of gradient than that of first slope portion 130A (i.e., more gently sloped) such that cap body 122 can be easily attached to opening portion 114. On the other hand, first slope portion 130A has a smaller angle of gradient than that of second slope portion 130B (i.e., more steeply sloped) such that cap body 122 is not easily detached from opening portion 114.

Further, space 134, which enables the inside tip of cap body 122 to deform in a direction of increasing its diameter, is formed between outer wall 122B of inside tip of cap body 122 and inner wall 114A of opening portion 114 on which engagement portion 132 is formed.

Further, O ring 136 is attached at outer wall 122B of cap body 122. O ring 136 prevents leakage of the liquid from a space formed between cap body 122 and opening portion 114 when cap body 122 is attached to opening portion 114.

Further, sealing film 138, which blocks penetration portion 122A and seals opening portion 114, is provided at the center of inner wall 122C of cap portion 122.

Figure 9:
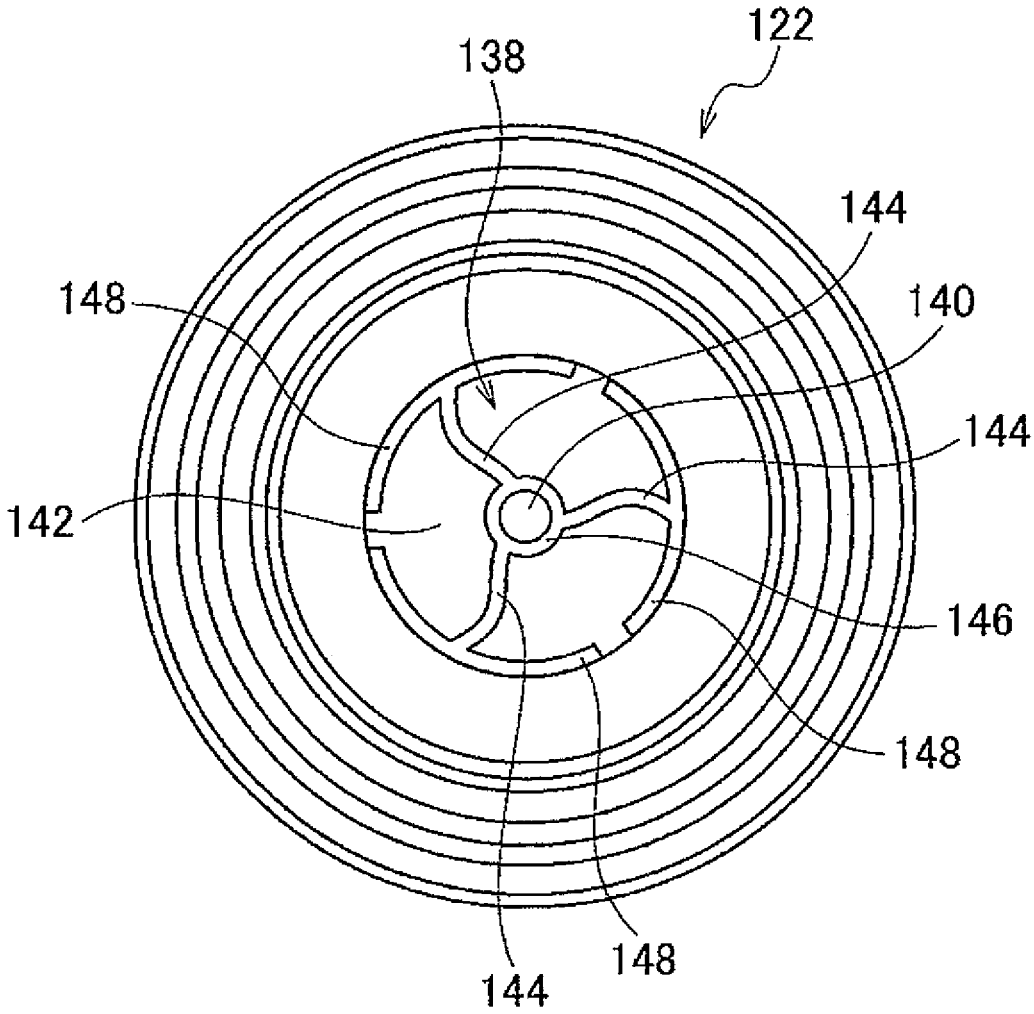
FIG. 9 is a plan view of the cap portion seen from side of an opening of the cap portion.

FIG. 9 is a plan view of cap body 122 (viewed from the side of the opening of cap body 122).

Sealing film 138 provided to cap body 122 has a circular shape viewed in plan view, and has a diameter that is greater than the width of punch member 80. Sealing film 138 mainly includes contact portion 140, which contacts the tip of punch member 80, that is formed at the center of sealing film 138 and has a circular shape viewed in plan view; surrounding portion 142 that surrounds the outer periphery of contact portion 140 and is connected to cap body 122; and at least one first breakage portion 144 that extends from contact portion 140 to the outer periphery of sealing film 138 across surrounding portion 142, and has a smaller thickness than that of contact portion 140 and surrounding portion 142.

Contact portion 140 is recessed from the surface of surrounding portion 142, and protrudes from a reverse surface thereof.

Further, first breakage portion 144 has a different shape from that of punch member 80. In the present exemplary embodiment, first breakage portion 144 is in the shape of three approximately S-shaped grooves radially extending from the center, when sealing film 138 is viewed in plan view.

The sealing film 138 preferably further comprises breakage induction portion 146. In this case, it is preferable that one end of first breakage portion 144 is connected to breakage induction portion 146 formed in sealing film 138. Breakage induction portion 146 is formed between contact portion 140 and surrounding portion 142, and connects contact portion 140 and surrounding portion 142. Breakage induction portion 146 has a smaller thickness than that of contact portion 140 and surrounding portion 142, and adapted so as to induce breakage of first breakage portion 144. Breakage induction portion 146 is a ring-shaped groove, when sealing film 138 is viewed in plan view. As a result, contact portion 140 protrudes (toward the side of opening of cap body 122) from the groove formed at the outer periphery thereof.

The thickness of first breakage portion 144 is the same as the thickness of breakage induction portion 146.

The thickness of first breakage portion 144 is preferably in a range of from 0.1 mm to 0.5 mm. When the thickness of first breakage portion is less than 0.1 mm, the thickness may be too small and when an external force is applied to the container, for example, when the container is dropped, the content thereof may leak out due to insufficient impact strength. When the thickness of first breakage portion is more than 0.5 mm, it may become difficult to allow a gas generated due to decomposition of urea to penetrate, thereby failing to maintain the shape of the container when it contains a liquid including urea, in addition to that it becomes difficult to cause breakage by punching.

The thickness of first breakage portion 144 is more preferably in a range of from 0.1 mm to 0.4 mm, particularly preferably in a range of from 0.2 mm to 0.3 mm, in view of the reasons as set forth above.

In order to secure gas permeability by adjusting the thickness to a range as set forth above, the material for first breakage portion 144 is preferably polyolefin, more preferably polyethylene.

Further, the width of the grooves formed as first breakage portion 144 also relates to gas permeability. When the thickness of first breakage portion 144 is within the above range, the width of first breakage portion 144 is preferably approximately from 0.01 mm to 2.0 mm, from the viewpoint of achieving favorable gas permeability and impact strength.

The other end of first breakage portion 144 is linked to second breakage portion 148. Second breakage portion 148 is formed along the outer periphery of sealing film 138, and has a smaller thickness than that of contact portion 140 and surrounding portion 142. Second breakage portion 148 is a ring-shaped groove formed with predetermined intervals, when sealing film 138 is viewed in plan view.

In the following, the function of the image forming liquid cartridge 110 according to the present exemplary embodiment will be explained.

Figure 10A:
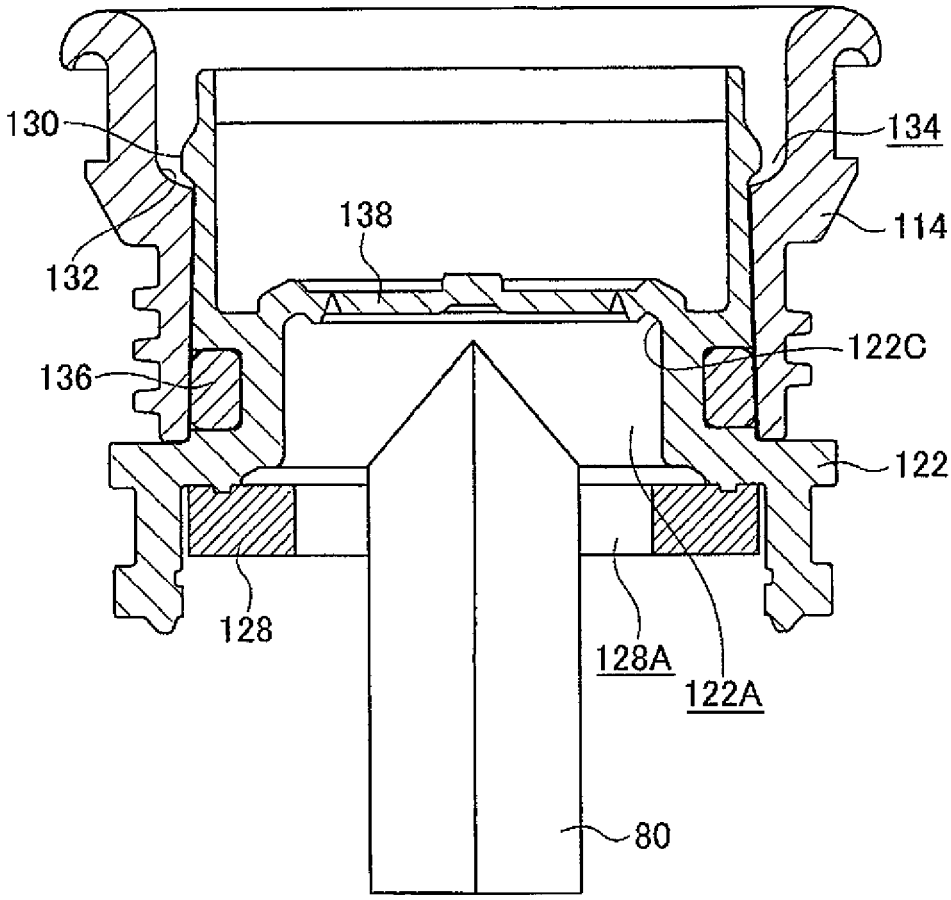
FIG. 10A illustrates the function of an image forming liquid cartridge according to an exemplary embodiment of the invention, before punching a sealing film with a punch member.
Figure 10B:
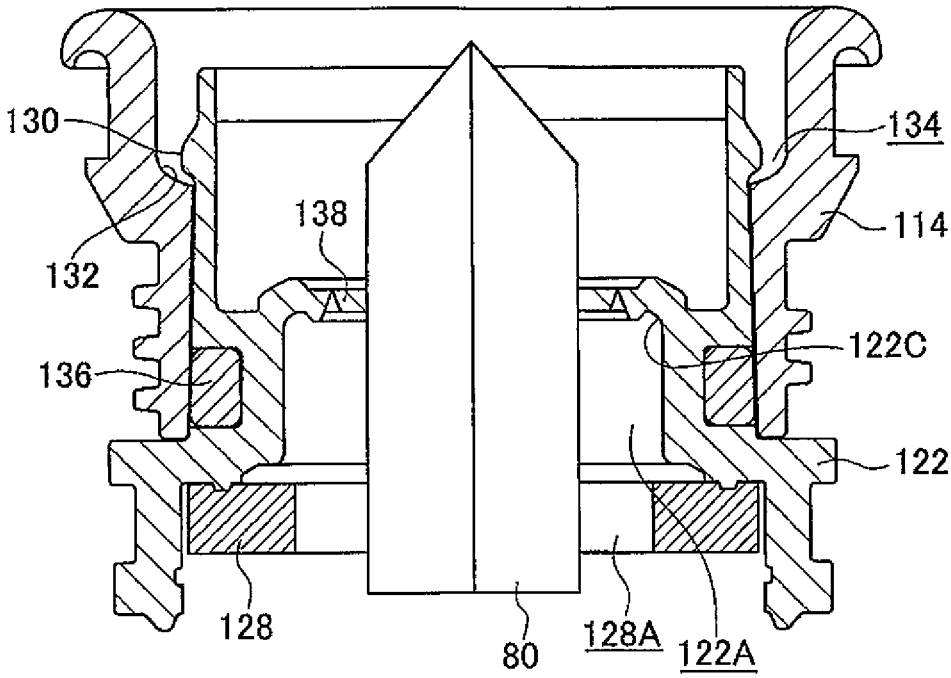
FIG. 10B illustrates the function of an image forming liquid cartridge according to an exemplary embodiment of the invention, after punching a sealing film with a punch member.

FIG. 10A and FIG. 10B are side views illustrating the functions of image forming liquid cartridge 110 according to the present exemplary embodiment, in which FIG. 10A shows a state before sealing film 138 is punched with punch member 80 and FIG. 10B show a state after sealing film 138 is punched with punch member 80. It should be noted that the state of sealing film 138 being punched, as described in FIG. 10B, is shown in a schematic manner, and the actual state is different from that.

Sealing film 138 of the image forming liquid cartridge 110 according to the present exemplary embodiment is punched with punch member 80, as shown in FIG. 10A and FIG. 10B. When sealing film 138 is punched with punch member 80, punch member 80 contacts contact portion 140 formed at the center of sealing portion shown in FIG. 9, and a stress is concentrated on contact portion 140. Therefore, at first breakage portion 144 having a smaller thickness than contact portion 140 and surrounding portion 142 of sealing film 138, the stress is easily transmitted from contact portion 140 to the outer periphery of sealing film 138. As a result, breakage of the entire body of first breakage portion 144 can be caused, and the area of the opening of sealing film 138 can be increased.

Further, since breakage induction portion 146, which has a smaller thickness than that of contact portion 140 and surrounding portion 142 of sealing film 138 and is connected to first breakage portion 144 to induce breakage of first breakage portion 144, is formed at the outer periphery of contact portion 140, the stress concentrated on contact portion 140 is directly transmitted to breakage induction portion 146 having a smaller thickness than that of contact portion 140 and surrounding portion 142 of sealing film 138 formed at the outer periphery 140, thereby causing breakage of breakage induction portion 146. As a result of this breakage, breakage of first breakage portion 144, which is connected to breakage induction portion 146, can be induced.

Moreover, since breakage induction portion 146 is formed at the outer periphery of contact portion 140, punch member 80 can be guided to contact portion 140.

Since contact portion 140 is recessed from the surface of surrounding portion 142 of sealing film 138 and protrudes from a reverse surface thereof, the tip of punch member 80 contacts contact portion 140 at a position recessed from the surface of sealing film 138, whereby the position gap of punch member 80 can be suppressed. Further, since contact portion 140 protrudes from a reverse surface and is thick, punch member 80 does not penetrate through contact portion 140.

Since first breakage portion 144 is in the form of approximately S-shaped grooves, the length of first breakage portion is more than that of the case in which first breakage portion 144 is in the form of straight grooves, whereby the length of breakage is increased and the area of opening of sealing film 138 can be increased. Further, since plural curved grooves are formed on sealing film 138 as first breakage portion 144, the area of opening of sealing film 138 can be further increased.

Moreover, since the S-shape of the grooves is different from the crossed shape of punch member 80, breakage of first breakage portion 144 can be caused to form an opening in sealing film 138 even if sealing film 138 adheres to punch member 80, and a liquid can be discharged from opening 144.

Cap body 122 is formed along the outer periphery of sealing film 138 and is connected to first breakage portion 144, and has second breakage portion 148 having a smaller thickness than that of contact portion 140 and surrounding portion 142 of sealing film 138. Therefore, when sealing film 138 is punched with punch member 80, breakage of second breakage portion 148, which is connected to first breakage portion 144, is also caused due to breakage of first breakage portion 144. Further, if at least a portion of second breakage portion 148 is broken, the outer periphery of sealing film 138 is opened, and a contact resistance with respect to punch member 80 can be reduced when pulling out punch member 80, whereby generation of abrasion residues of sealing film 138 can be suppressed.

By providing plural second breakage portions 148 while leaving intervals therebetween, it is possible to leave unbroken portions at the outer periphery of sealing film 138, i.e., portions at which sealing film 138 and cap body 122 is connected, while reducing abrasion resistance with respect to punch member 80. As a result, detachment of sealing film 138 from cap body 122 can be prevented.

Since cap portion 94 is adapted to be attached to opening portion 114, the structure of cap portion 94 can be simplified, and a secure engagement with opening portion 114 can be achieved without the need of complicated operations such as torque management, which is necessary for common screw caps.

Since cap portion 94 has a cylindrical cap body 122 and claw portion 130 formed as a protrusion at outer wall 122B of cap body 122, and claw portion 130 is engaged with engagement portion 132 provided at inner wall 114A of opening portion 114, detachment of cap portion 94 from opening portion 114 due to fluid pressure can be prevented.

Since space 134 is formed at inner wall 114A of opening portion 114 on which engagement portion 132 is formed, such that the tip of cap body 122 having a cylindrical shape can be deformed in a direction of increasing its diameter, for example, the tip of cap body 122 is deformed in a direction of increasing its diameter due to an increase in internal pressure caused by an impact, whereby engagement of claw portion 130 with engagement portion 132 is further strengthened. As a result, detachment of cap portion 94 from opening portion 114 can be prevented.

The liquid-filled container, which is obtained by filling image forming liquid cartridge 110 with ink, can be produced by a method including a step of providing a liquid container 113 having opening portion 114 from which ink is to be filled; a step of filling liquid container 113 with ink; and a step of attaching cap portion 94 as explained above to opening portion 114.

In the following, another exemplary embodiment of the present invention, which is different from the aforementioned embodiment, will be explained.

Figure 11:
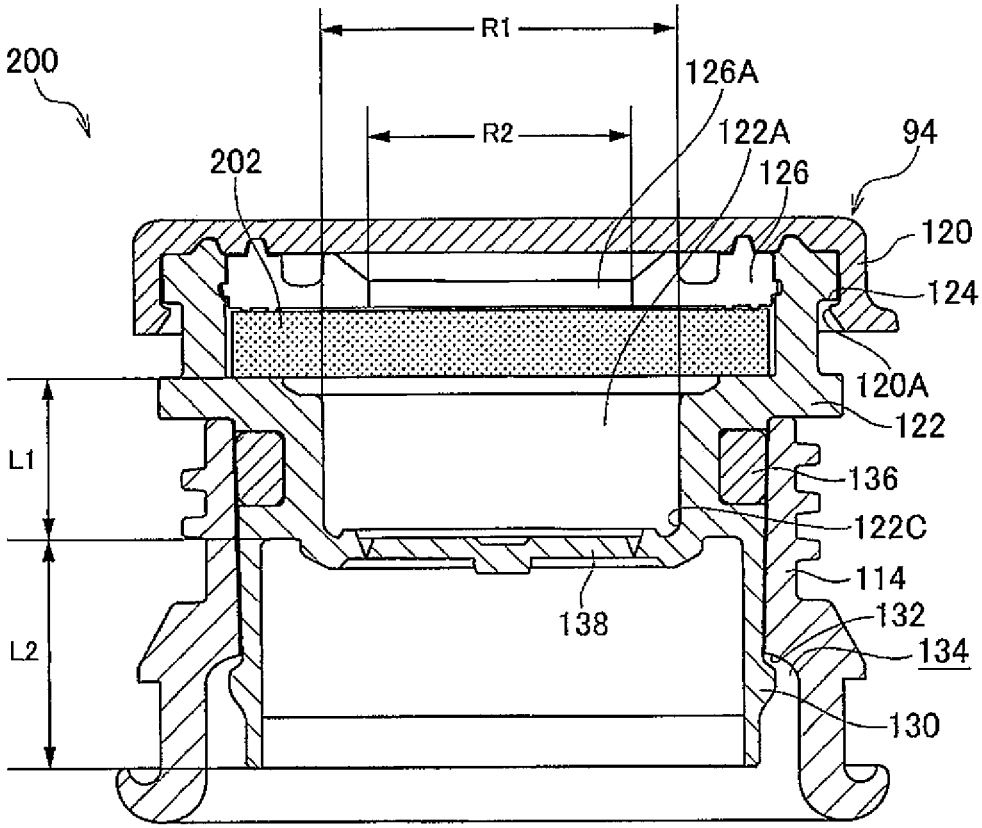
FIG. 11 is a sectional view showing the structure of a cap portion of an image forming liquid cartridge according to another exemplary embodiment of the invention.

FIG. 11 is a cross sectional view showing a cap portion of the image forming liquid cartridge according to the other exemplary embodiment of the invention.

Image forming liquid cartridge 200 according to the other exemplary embodiment of the invention has a similar structure to the structure of image forming liquid cartridge 110 according to the previously explained embodiment, but is different in that elastic sealing member 202 is used instead of supporting plate 128 in cap portion 94.

Elastic sealing member 202 is attached inside cap portion 94 at a position that is closer to an opening of cap portion 94 than sealing film 138, and seals opening portion 114 together with sealing film 138. However, unlike sealing film 138, elastic sealing member 202 can seal opening portion 114 even after sealing film 138 has been punched, as described later.

The distance L1 between elastic sealing member 202 and sealing film 138 is preferably longer, for example 10.0 mm, from the viewpoint of the difference between the timing of pulling out punch member 80 from sealing film 138 and the timing of pulling out punch member 80 from elastic sealing member 202. The distance L2 between sealing film 138 and the inside edge of cap body 122 (at the side of image forming liquid cartridge 200) is not particularly limited, but may be 14.3 mm, for example.

The diameter R1 of penetration portion 122A in the vicinity of sealing film 138 may be 21.4 mm, for example, and the diameter R2 of penetration 126A formed by holding plate 126 may be 15.5 mm, for example.

Figure 12:
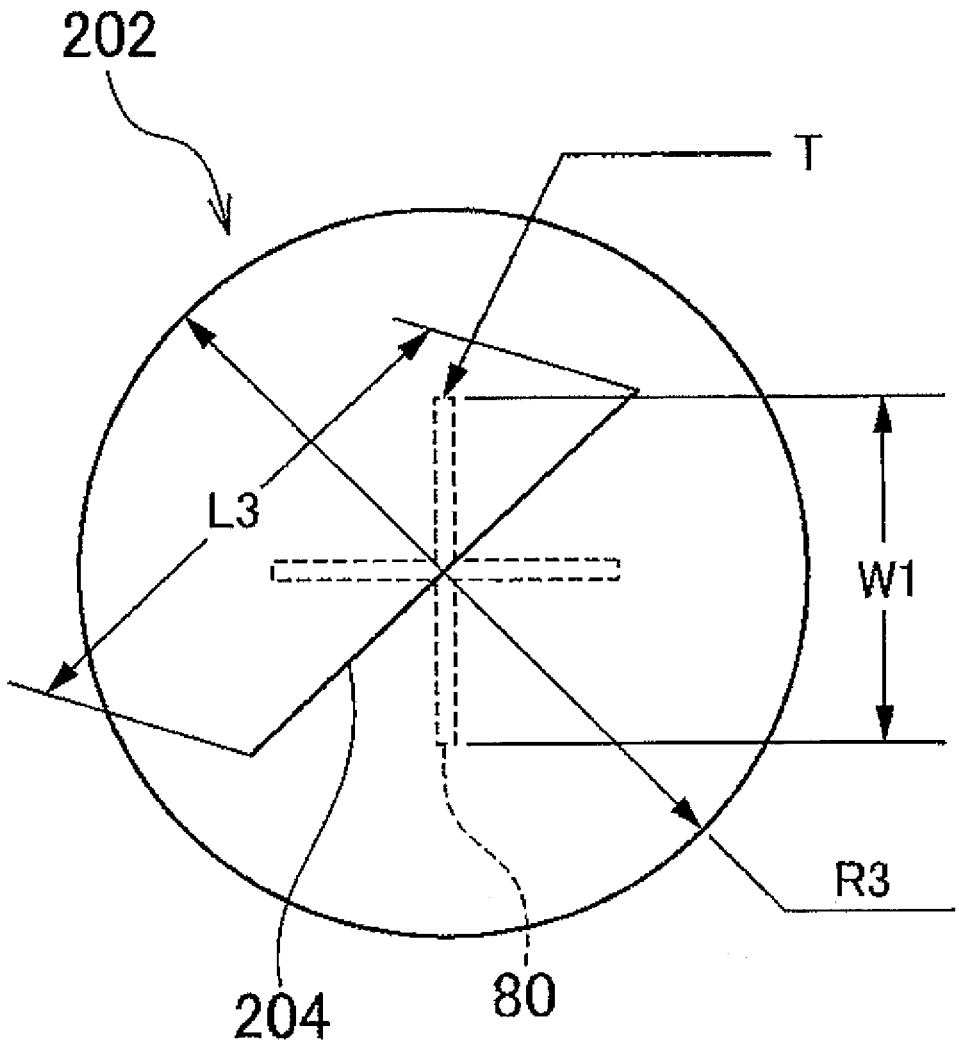
FIG. 12 is a front view of an elastic sealing member.

FIG. 12 is a front view of elastic sealing member 202.

Elastic sealing member 202 is made from silicone rubber, and has flexibility and a disk shape. The diameter of elastic sealing member 202, indicated by R3, is not particularly limited and may be 32.0 mm, for example.

Slit 204, which has a straight-line shape and penetrates from one side to the other side of elastic sealing member 202, is provided at the center of the disk-shaped surface of elastic sealing member 202. Slit 204 is closed in its ordinary state due to an elastic force of elastic sealing member 202 so that a liquid cannot flow from slit 204. However, when sealing film 138 is punched with punch member 80, slit 204 is pushed open with punch member 80 and a liquid can flow from slit 204.

The length of slit 204, indicated by L3, may be 20.0 mm, for example. The width of punch member 80, indicated by W, is not particularly limited and may be 15.0 mm, for example, in the present exemplary embodiment. The thickness of punch member 80, indicated by T, may be 1.0 mm, for example.

In the following, functions of image forming liquid cartridge 200 are explained.

Figure 13A:
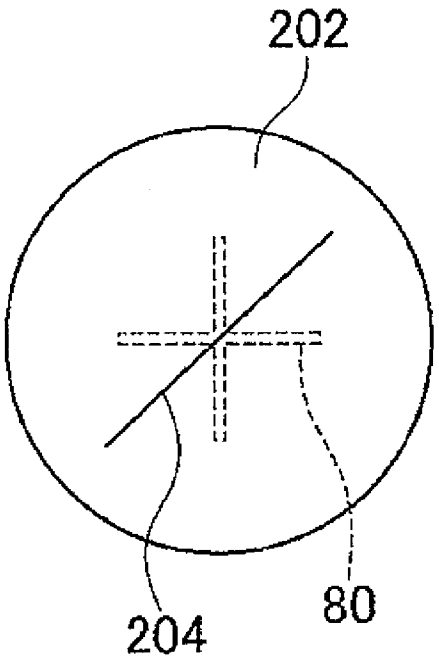
FIG. 13A illustrates the function of an image forming liquid cartridge according to another exemplary embodiment of the invention, before being punched with a punch member.
Figure 13B:
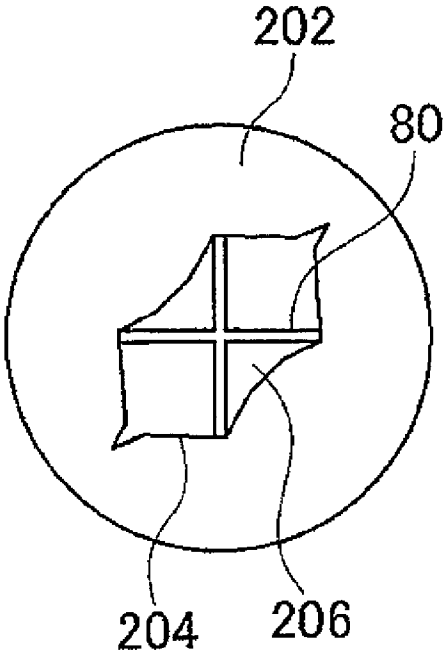
FIG. 13B illustrates the function of an image forming liquid cartridge according to another exemplary embodiment of the invention, during punching with a punch member.
Figure 13C:
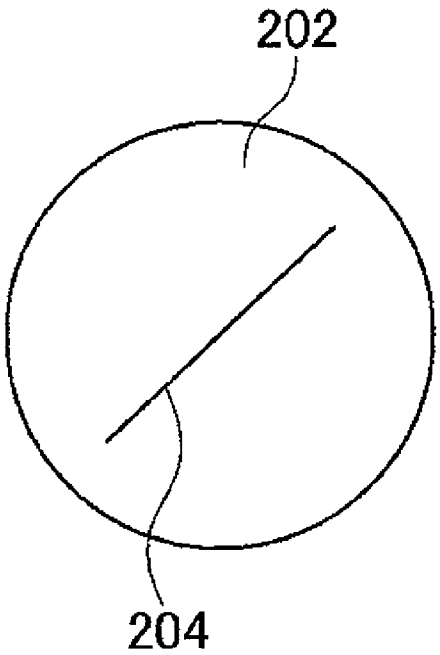
FIG. 13C illustrates the function of an image forming liquid cartridge according to another exemplary embodiment of the invention, after being punched with a punch member.

FIGS. 13A to 13C illustrate the functions of image forming liquid cartridge 200 according to the present exemplary embodiment. Specifically, FIG. 13A shows a state prior to being punched with punch member 80; FIG. 13B shows a state of being punched with punch member 80; and FIG. 13C shows a state after being punched with punch member 80.

As shown in FIG. 13A and FIG. 13B, when punch member 80 is inserted into cap portion 94, slit 204 of elastic sealing member 202 is pushed open with punch member 80 into a rectangular shape. If the length of slit 204 prior to being pushed open is defined as L3, the total length of the four sides of the rectangular slit 204 after being pushed open with punch member 80 is increased by up to 10%, resulting in the total length within a range of from 2×L3 to 2×L×110%.

When sealing film 138 is broken with punch member 80, a liquid contained in liquid container 113 starts to flow out downward. The liquid is guided to pipe 46 through space 206 formed by the outer walls of punch member 80 and the inner walls of slit 204 being pushed open into a rectangular shape, and is supplied to main ink tank 21, which is a supply destination, through pipe 46. Compared with a case in which punch member 80 is a hollow needle (e.g., an injection needle) and a liquid is discharged via the hollow portion, in the present exemplary embodiment, path walls that may inhibit flowing out of the liquid are not formed in the path (space 206), and the liquid does not accumulate in the vicinity of the opening. In other words, the present exemplary embodiment provides a structure that allows the complete discharge of the liquid through the path (space 206) formed by the outer walls of punch member 80 and the inner walls of slit 204.

Subsequent to the state shown in FIG. 13B, when punch member 80 is pulled out from opening portion 114, slit 204 is shut again due to the elastic force of elastic sealing member 202, as shown in FIG. 13C. Therefore, leakage of the liquid that may remain in liquid container 113 can be prevented.

The above explanation is based on specific exemplary embodiments of the invention, but the invention is not limited to these specific exemplary embodiments, and it is obvious for one skilled in the art to alter the exemplary embodiments into other various types within a scope of the invention. For example, the exemplary embodiments may be combined appropriately, or may be combined with the following alternatives appropriately.

Specifically, the aforementioned exemplary embodiments are explained based on a case in which first breakage portion 144 has three grooves extended from breakage induction portion 146, as shown in FIG. 9. However, the number of grooves of first breakage portion 144 is not limited to three, and may be two or more than four. From the viewpoint of securing sufficient impact strength with respect to an outer force (for example, falling of the container) and securing a sufficient penetration amount of a gas generated in the container, an embodiment in which the ring-shaped periphery of the breakage induction portion is uniformly divided into two to five regions by two to five grooves is preferred, and an embodiment in which the periphery of the ring-shaped breakage induction portion is uniformly divided into two or three regions by two or three grooves is more preferred.

Figure 14:
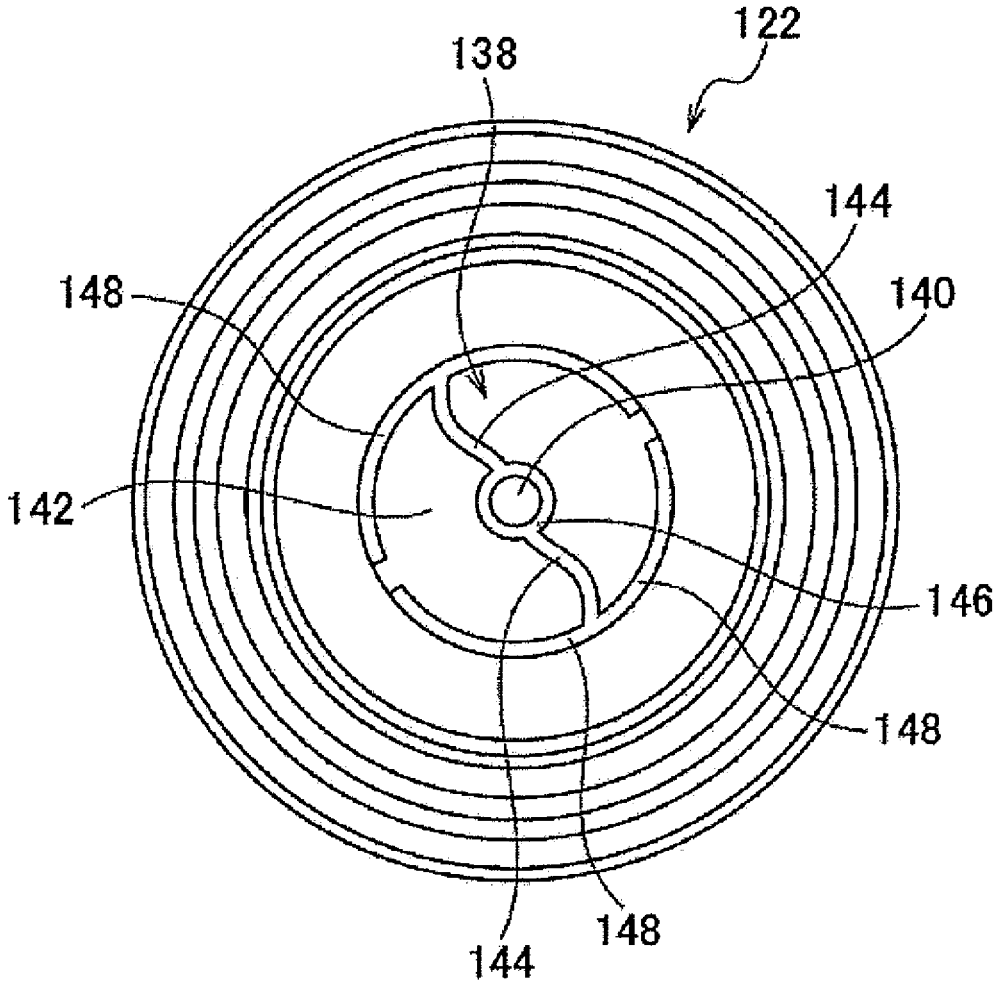
FIG. 14 is a plan view of a cap portion of another exemplary embodiment (viewed from the side of an opening portion of the cap portion).

For example, as shown in FIG. 14, when sealing film 138 is uniformly divided into two regions by providing two grooves at the ring-shaped periphery of the breakage induction portion, first breakage portion 144 has two grooves extended from breakage induction portion 146.

For example, in the above exemplary embodiments, liquid container 113 is placed in carton 112 and attached to carton adaptor 92. However, liquid 113 may be directly attached to carton adaptor 92 without carton 112.

In addition, in the above exemplary embodiments, the thickness of first breakage portion 144 is described as being the same as the thickness of breakage induction portion 146.

However, the thickness of first breakage portion 144 may be greater than the thickness of breakage induction portion 146. In that case, breakage induction portion 146 is broken prior to the breakage of first breakage portion 144 by a stress concentrated on contact portion 140, thereby increasing the certainty of inducing the breakage of first breakage portion 144.

Conversely, the thickness of first breakage portion 144 may be smaller than the thickness of breakage induction portion 146. In that case, breakage induction portion 146 is prevented from being entirely broken, thereby preventing falling of contact portion 140.

Further, in the above exemplary embodiments, contact portion 140 is described as being recessed from the surface of surrounding portion 142 and protruding from its reverse surface. However, contact portion 140 may not be recessed from the surface of surrounding portion 142, or may be recessed from the back side of surrounding portion 142 and protrudes from its front surface. If contact portion 140 protrudes from the front surface of surrounding portion 142, certainty that punch member 80 contacts contact portion 140 prior to contacting the other regions can be increased.

The following are exemplary embodiments of the invention. However, the invention is not limited to these exemplary embodiments.

<1> A first aspect of the invention is an image forming liquid cartridge comprising:

a container having an opening portion from which an image forming liquid is fed or discharged;

a cap portion connected to the opening portion; and an image forming liquid contained in the container, the image forming liquid comprising a colorant, urea and water, and having a pH of 7.5 or more, wherein the cap portion comprises a sealing portion that seals the opening portion, a contact portion provided at the center of the sealing portion and adapted such that a punch member that punches the sealing portion contacts the contact portion, and at least one first breakage portion that extends from the contact portion to an outer periphery of the sealing portion, and has a thickness of from 0.1 mm to 0.5 mm, the thickness of the at least one first breakage portion being smaller than a thickness of the sealing portion.

According to an embodiment of the image forming liquid cartridge described in <1>, in which a thin first breakage portion having a thickness of from 0.1 mm to 0.5 mm is provided, a gas generated in the cartridge when it contains an image forming liquid that tends to generate a gas including ammonia or carbon dioxide is discharged out of the cartridge from the first breakage portion. As a result, a phenomenon in which the container is significantly deformed can be suppressed, and deformation from its original shape can be suppressed even when the container is placed under a relatively high temperature or stored for a long term. Consequently, collapse of a stack of the containers or breakage of the containers can be prevented. In addition, when punching the sealing portion with a punch member, a stress created by the punch member contacting the contact portion formed at the center of the sealing portion is concentrated on the contact portion. As a result, transmission of the stress from the contact portion to the outer periphery of the sealing portion becomes easier at the first breakage portion having a smaller thickness than that of the sealing portion, compared to the sealing portion. Accordingly, breakage of the entire body of the first breakage portion can be caused, and the area of an opening formed in the sealing portion can be increased.

<2> The image forming liquid cartridge described in <1>, wherein the image forming liquid cartridge comprises two or more of the first breakage portions. In the image forming liquid cartridge described in <1>, it is preferable that the first breakage portion includes two or more of the first breakage portions which are small-thickness portions extending from the contact portion to the outer periphery of the sealing portion. By providing plural small-thickness portions as first breakage portions extending from the contact portion to the outer periphery of the sealing portion, favorable permeability of a gas can be achieved while maintaining a certain impact strength, and deformation of the cartridge can be effectively suppressed even if the amount of a gas generated from the liquid contained in the cartridge is relatively large.

In particular, the image forming liquid cartridge preferably includes two or three of the first breakage portions. In that case, the area of the opening formed in the sealing portion can be further increased and even more favorable gas permeability can be achieved, while maintaining certain impact strength.

<3> The image forming liquid cartridge described in <1> or <2>, wherein the content of urea contained in the image forming liquid is from 1.0% by mass to 10.0% by mass with respect to the total mass of the image forming liquid.

When the content of urea in the image forming liquid is within the above range, the amount of a gas generated due to decomposition of urea or the like tends to be relatively large. However, even if a liquid having such a composition is contained in the container, deformation of the cartridge can be suppressed, and deformation of the cartridge from its original shape can be suppressed even when the container is placed under a relatively high temperature or stored for a long term. Consequently, an effect of preventing the collapse of a stack of the containers or the breakage of the containers can be even more remarkable.

<4> The image forming liquid cartridge described in any one of <1> to <3>, wherein a breakage induction portion is provided at the outer periphery of the contact portion, the breakage induction portion having a smaller thickness than the thickness of the sealing portion and being connected to the at least one first breakage portion and adapted so as to induce breakage of the first breakage portion.

According to an embodiment described in <4>, a stress concentrated on the contact portion is directly transmitted to the breakage induction portion that is formed at the outer periphery of the contact portion and has a smaller thickness than that of the sealing portion, thereby causing breakage of the breakage induction portion. By means of the breakage of the breakage induction portion, breakage of the first breakage portion, which is connected to the breakage induction portion, can be induced.

Further, since the breakage induction portion is formed at the outer periphery of the contact portion, it also guides the punch member to the contact portion.

<5> The image forming liquid cartridge described in any one of <1> to <4>, wherein the contact portion is recessed from a front surface of the sealing portion and protrudes from a reverse surface of the sealing portion.

According to an embodiment described in <5>, since the tip of the punch member contacts the contact portion at a position being recessed from a front surface of the sealing portion, relative mismatch of the position with respect to the punch member can be suppressed. In addition, since the contact portion protrudes from a reverse surface of the sealing portion, thereby having a large thickness, the punch member can punch only the contact portion without affecting the breakage portion.

<6> The image forming liquid cartridge described in any one of <1> to <5>, wherein the at least one first breakage portion is a curved groove when the sealing portion is viewed in plan view.

<7> The image forming liquid cartridge described in any one of <1> to <6>, wherein the at least one first breakage portion is an S-shaped groove when the sealing portion is viewed in plan view.

According to the structure described in <6> or <7>, since the first breakage portion is formed as curved grooves, the length of the first breakage portion is made longer than a case in which the first breakage portion is a straight line. As a result, the length of breakage can be increased and the area of the opening formed in the sealing portion can be increased. From this point of view, the first breakage portion is preferably S-shaped from among the curved shapes. When the first breakage portion is S-shaped, it is less likely for the shape of the first breakage portion to follow the shape of a common punch member. As a result, even if the sealing portion adheres to the punch member, an opening can be formed in the sealing portion by breakage of the first breakage portion and a liquid can flow out from the opening.

In addition, since plural curved grooves are formed in the sealing portion as the first breakage portion, the area of the opening formed in the sealing portion can be further increased.

<8> The image forming liquid cartridge described in any one of <1> to <7>, further comprising a plurality of second breakage portions provided along an outer periphery of the sealing portion at a certain interval, the second breakage portions being connected to the at least one first breakage portion and having a smaller thickness than the thickness of the sealing portion.

According to the structure described in <8>, when the sealing portion is punched with a punch member, not only the first breakage portion but also the second breakage portions, which are connected to the first breakage portion, are broken. When the second breakage portions are partially broken, an opening is formed in the outer periphery of the sealing portion and a contact resistance with respect to the punch member can be reduced during pulling out the punch member from the sealing portion, thereby preventing generation of abrasion dusts at the sealing portion. In addition to reducing the contact resistance with respect to the punch member by providing plural second breakage portions, it is also possible to leave unbroken portions at the outer periphery of the sealing portion by providing certain intervals between the plural second breakage portions, i.e., at portions at which the sealing portion and the cap portion are connected to each other. As a result, falling of the sealing portion from the cap portion can be prevented.

<9> The image forming liquid cartridge described in any one of <1> to <8>, wherein the cap portion is attached to the opening portion.

According to the structure described in <9>, the configuration of the cap portion can be simplified, and secure engagement of the cap portion with the opening can be achieved without the need of complicated operations such as torque management, which is necessary for common screw caps.

<10> The image forming liquid cartridge described in any one of <1> to <9>, further comprising an elastic sealing member having a slit, the elastic sealing member being provided at the cap portion at a position closer to an opening of the cap portion than the sealing portion.

According to the structure described in <10>, when the container is set with its opening downward and the sealing portion is punched by inserting a punch member into the cap portion, the sealing portion is punched after the elastic sealing member is pushed open by the punch member. Further, when the punch member is pulled out from the opened sealing portion, a residual liquid remaining in the image forming liquid cartridge is received by the elastic sealing member. After pulling out the punch member from the elastic sealing portion, the slit, which has been pushed open by the punch member, is shut by means of an elastic force of the elastic sealing member. As a result, leakage of a liquid remaining in the container from the cap portion can be prevented.

<11> The image forming liquid cartridge described in any one of <1> to <10>, wherein the cap portion comprises a cylindrical body and a claw portion formed as a protrusion at an outer wall of the cylindrical body, the claw portion being adapted to be engaged with an engagement portion formed at an inner wall of the opening portion.

According to the structure described in <11>, falling of the cap portion from the opening due to a liquid pressure can be prevented.

<12> The image forming liquid cartridge described in any one of <1> to <11>, wherein a space, in which a tip of the cylindrical body can be deformed in a direction of increased diameter, is provided at the inner wall of the opening portion at which the engagement portion is formed.

According to the structure described in <12>, the tip of the cylindrical body is deformed in a direction of increasing the diameter of the cylindrical body caused by an increase in the inner pressure created by an impact or the like, thereby strengthening the engagement of the claw portion and the engagement portion. As a result, falling of the cap portion from the opening can be prevented.

<13> A second aspect of the invention is an image forming apparatus including:

the image forming liquid cartridge described in any one of <1> to <12>; and a punch member that punches the sealing portion of the image forming liquid cartridge, wherein, in the image forming liquid cartridge, the punch member has a different shape than the shape of the at least one first breakage portion.

According to the structure described in <13>, the image forming liquid cartridge can be easily placed at a predetermined position and, by using a punch member having a different shape than that of the first breakage portion, the first breakage portion is broken to form an opening to the sealing member to allow a liquid to flow our from the opening, even when the sealing member adheres to the punch member.

EXAMPLES

In the following, the invention is explained in further details with reference to the examples. However, the invention is not limited to these examples. The term "part" is based on mass, unless otherwise indicated.

Example 1

Preparation of Ink

—Synthesis of Water-Insoluble Polymer 1—

To a 1000-ml three-necked flask having a stirrer and a condenser tube, methyl ethyl ketone (88 g) was added and heated to 72° C. under a nitrogen atmosphere. A solution prepared by dissolving dimethyl 2,2-azobis isobutylate (0.86 g), benzyl methacrylate (60 g), methacrylic acid (10 g) and methyl methacrylate (30 g) in methyl ethyl ketone (50 g) was dropped into the flask over three hours. After the completion of the dropping, the mixture was further allowed to reaction for one hour, a solution prepared by dimethyl 2,2'-azobis isobutylate (0.40 g) in methyl ethyl ketone (2 g) was added thereto, and the temperature was increased to 80° C. and heated for four hours. The obtained reaction solution was re-precipitated twice with an overly excess quantity of hexane, and a precipitated resin was dried. Water-insoluble polymer 1 (96 g) was thus obtained.

The composition of the water-insoluble polymer was confirmed by $^1$H-NMR. The weight-average molecular weight (Mw) as measured by GPC was 43300. Further, the acid value of the water-insoluble polymer was calculated by a method described in RS standard (JIS K 0070:1992), and the result was 64.6 mgKOH/g.

—Preparation of Resin-Coated Magenta Pigment Dispersion—

The following components were mixed and dispersed for three to six hours with a bead mill and zirconia beads having a diameter of 0.1 mm. Subsequently, methyl ethyl ketone was removed from the obtained dispersion at 55° C. under reduced pressure, and part of water was further removed. A resin-coated magenta pigment dispersion, in which the concentration of the magenta pigment was 15.0% by mass, was thus prepared.

<Composition of Resin-Coated Magenta Pigment Dispersion>

| | |
|---|---|
| C.I. Pigment Red 122 pigment powder (CROMOPHTHAL JET MAGENTA DMQ, trade name, manufactured by BASF Japan, magenta pigment) | 10.0 parts |
| Water-insoluble polymer 1 (water-insoluble resin) | 4.0 parts |
| Methyl ethyl ketone (organic solvent) | 30.5 parts |
| 1 mol/1 NaOH aqueous solution (neutralizing agent) | 5.6 parts |
| Ion exchange water | 98.7 parts |

—Preparation of Polymer Dispersion—

In a two-liter three-necked flask having a stirrer, a thermometer, a reflux condenser tube and a nitrogen gas introduction tube, methyl ethyl ketone (360.0 g) was placed and the temperature was increased to 75° C. While maintaining the inside temperature of the reaction container at 75° C., a mixture of methyl methacrylate (158.4 g), methoxyethyl acrylate (54.0 g), benzyl methacrylate (126.0 g), methacrylic acid (21.6 g), methyl ethyl ketone (72 g) and V-601 (manufactured by Wako Pure Chemical Industries, Ltd.) (1.44 g) was dropped at a constant ratio over two hours. After the completion of the dropping, a solution of V-601 (0.72 g) and methyl ethyl ketone (36.0 g) was further added and stirred at 75° C. over three hours, and a solution of V-601 (0.72 g) and methyl ethyl ketone (36.0 g) was further added and stirred at 75° C. over two hours. Thereafter, the temperature was increased to 85° C. and stirred for 2.5 hours, thereby obtaining a polymer solution. The weight average molecular weight (Mw) of the copolymer was as measured by GPC (polystyrene standard, columns: TSKGEL SUPER HZM-H, TSKGEL SUPER HZ4000 and TSKGEL SUPER HZ200, trade names, manufactured by Tosoh Corporation) was 68000.

Subsequently, the obtained polymer solution (668.3 g) was weighed, and isopropanol (388.3 g) and a 1 mol/L NaOH aqueous solution (145.7 ml, neutralization degree: 60%) were added thereto and the inside temperature of the reaction container was increased to 80° C. Thereafter, pure water (720.1 g) was dropped at a rate of 20 ml/min to obtain an aqueous dispersion. Then, after maintaining the inside temperature of the reaction container at 80° C. for two hours, at 85° C. for two hours and at 90° C. for two hours, the inside pressure of the reaction container was reduced to distil away isopropanol, methyl ethyl ketone and pure water at the total amount of 913.7 g. Polymer dispersion C having the following structure (solid content concentration: 28.0%) was thus obtained. The numbers at the bottom right of the parentheses indicate the mass ratio of the structural units.

Polymer Dispersion C

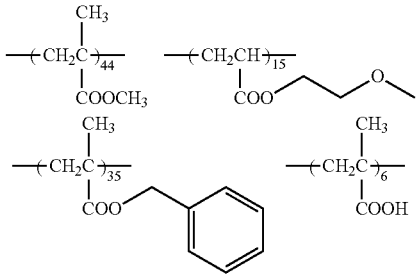

—Preparation of Magenta Ink—

Ink M-1 was prepared by preparing an ink having the following composition, using the dispersion obtained in the above process, and filtrating the ink with a 0.2-μm membrane filter.

<Composition of ink M-1>

| | |
|---|---|
| Resin-coated magenta pigment dispersion (obtained above) (solid content concentration of magenta pigment) | 5% by mass |
| SANNIX GP-250 (NEWPOL GP-250, trade name, Sanyo Chemical Industries, Ltd.) | 10% by mass |
| Triethylene glycol monomethyl ether | 3% by mass |
| Dipropylene glycol | 5% by mass |
| Polymer dispersion C (obtained above) (solid content concentration of copolymer) | 7% by mass |
| EM46D (carnauba wax) | 1% by mass |
| Urea | 5% by mass |
| OLFINE E1010 (nonionic surfactant, trade name, manufactured by Nisshin Chemical Co., Ltd.) | 0.5% by mass |
| PROXEL XL2 (1,2-benzisothiazolin-3-one, trade name, manufactured by Avecia Inc.) | 0.3% by mass |
| Ion exchange water | balance |

The pH of the obtained ink M-1 was 8.5. Specifically, the pH of the undiluted aqueous ink was measured at 25° C.±1° C. with a pH meter (WM-50EG, trade name, manufactured by DKK-TOA Corporation).

Further, plural inks were prepared in a similar manner to ink M-1, except that the addition amount of urea was changed as shown in Table 1, and the pH of the inks was measured by a method described above. The results are shown in Table 1.

[Preparation of Image Forming Apparatus]

As an image forming apparatus, an inkjet recording apparatus having a similar structure to the structure shown in FIGS. 1 to 10 was prepared.

Image forming liquid cartridge 110, made of polyethylene, was filled with magenta ink M-1, and the cartridge was placed in carton (paper box) 112, thereby producing ink cartridge (image forming liquid cartridge) 90. This ink cartridge is attached to cartridge adaptor 92 of the ink jet recording apparatus, and constitutes tank unit 42. Further, as an example of the first breakage portion, grooves having a width of 0.5 mm are provided to sealing film 138 provided to cap portion 122 of ink cartridge 90, by the number and the thickness as indicated in Table 1.

[Evaluation]

The following experiment and evaluation were carried out using the ink cartridge prepared in the above process and the inkjet recording apparatus in which the ink cartridge was installed. The results of the experiment and the evaluation are shown in Table 1.

1. Expansion of Container

After filling a 1200-ml image forming liquid cartridge made of polyethylene with ink M-1, the cartridge was sealed with a cap while applying a pressure thereto. Thereafter, the width $W^0$ at the center of the container in a height direction thereof (direction Y shown in FIG. 6) was measured with a slide gauge, and the container was stored under a constant temperature of 60° C. for one month. After the storage, the width $W^1$ of the container was measured at the same position with a slide gauge, and an increase rate (%; $=W^1/W^0 100$) was calculated to evaluate a degree of expansion of the container.

From the viewpoint of maintaining a favorable appearance of the container or preventing collapse or breakage of the container when stacked, it is favorable when the increase rate is 3% or less, desirably 2% or less, in terms of product quality.

2. Falling Test

A 10-liter molded liquid container (FUJITAINER, trade name, manufactured by Fujimori Kogyo Co., Ltd.) was filled with 10 liter of water, and sealed with a cap having a similar structure to that described in FIG. 8 to FIG. 10 and placed in a cardboard box for exclusive use. A falling test was carried out by dropping the cardboard box five times from a height of 1.5 m, and visually examining the state of breakage of the cap after the test. The results are evaluated according to the following criteria. Since the falling test was carried out for the purpose of evaluating the strength of the cap portion, water was contained in the container instead of ink.

<Evaluation Criteria>

A: The cap did not break even after the fifth dropping.

B: The cap broke after the fourth or fifth dropping, and the content leaked out of the container.

C: The cap broke after the first to third dropping, and the content leaked out of the container.

3. Removability

An ink droplet (10 μl) was formed on a thoroughly cleaned glass slide, and dried at 40° C. for three hours. Cotton gauze was soaked with pure water and squeezed so that the water did not drip, and the dried ink droplet was removed with the cotton gauze under load of 200 g/cm$^2$. The results were evaluated according to the following criteria.

<Evaluation Criteria>

A: Ink was removed such that the shape of the ink was not recognized on the glass slide.

B: A slight amount of the ink remained on the glass slide, but most of the ink adhered to the gauze.

C: Most of the ink remained on the glass slide, and only a slight amount of the ink adhered to the gauze.

D: The ink could hardly removed.

TABLE 1

| | | | | Grooves | | Expansion | | | |
|---|---|---|---|---|---|---|---|---|---|
| No. | Ink Type | Urea Amount [mass %] | pH | Number of grooves | Thickness [mm] | rate of container [%] | Falling Test | Removability | Notes |
| 101 | Ink M-1 | 5 | 8.5 | — | | 6 | A | A | Comparative |
| 102 | Ink M-2 | not added | 8.5 | — | | 0 | A | D | Comparative |
| 103 | Ink M-1 | 5 | 8.5 | 2 | 0.8 | 6 | A | A | Comparative |
| 104 | Ink M-1 | 5 | 8.5 | 2 | 0.5 | 3 | A | A | Invention |
| 105 | Ink M-1 | 5 | 8.5 | 2 | 0.3 | 3 | A | A | Invention |
| 106 | Ink M-1 | 5 | 8.5 | 2 | 0.1 | 2 | B | A | Invention |
| 107 | Ink M-1 | 5 | 8.5 | 2 | 0.05 | 0 | C | A | Comparative |
| 108 | Ink M-1 | 5 | 8.5 | 3 | 0.8 | 6 | A | A | Comparative |
| 109 | Ink M-1 | 5 | 8.5 | 3 | 0.5 | 3 | A | A | Invention |
| 110 | Ink M-1 | 5 | 8.5 | 3 | 0.3 | 2 | A | A | Invention |
| 111 | Ink M-1 | 5 | 8.5 | 3 | 0.2 | 1 | A | A | Invention |
| 112 | Ink M-1 | 5 | 8.5 | 3 | 0.1 | 0 | B | A | Invention |
| 113 | Ink M-1 | 5 | 8.5 | 3 | 0.05 | 0 | C | A | Comparative |
| 114 | Ink M-1 | 5 | 8.5 | 4 | 0.3 | 3 | B | A | Invention |
| 115 | Ink M-1 | 5 | 8.5 | 5 | 0.3 | 3 | B | A | Invention |
| 116 | Ink M-2 | not added | 8.5 | 3 | 0.2 | 0 | A | D | Comparative |
| 117 | Ink M-3 | 3 | 8.5 | 3 | 0.2 | 2 | A | B | Invention |
| 118 | Ink M-4 | 8 | 8.5 | 3 | 0.2 | 3 | A | A | Invention |
| 119 | Ink M-5 | 10 | 8.5 | 3 | 0.2 | 3 | A | A | Invention |

Example 2

Inks having different pHs were prepared in a similar manner to the preparation of ink M-1 (addition amount of urea: 5% by mass), except that the pH was adjusted with a 47% by mass sulfuric acid or 50% by mass sodium hydroxide, as shown in Table 2. The experiment and the evaluation were carried out. The results are shown in Table 2.

TABLE 2

| Ink Type | pH | Grooves Number of grooves | Grooves Thickness [mm] | Expansion rate of container [%] | Falling Test | Removability | Notes |
|---|---|---|---|---|---|---|---|
| Ink M-111 | 8.5 | 3 | 0.2 | 1 | A | A | Invention |
| Ink M-201 | 7.0 | 3 | 0.2 | 0 | A | D | Comparative |
| Ink M-202 | 7.5 | 3 | 0.2 | 1 | A | B | Invention |
| Ink M-203 | 9.0 | 3 | 0.2 | 2 | A | A | Invention |
| Ink M-204 | 10.0 | 3 | 0.2 | 3 | A | B | Invention |
| Ink M-205 | 10.0 | — | | 10 | A | B | Comparative |

Example 3

Inks K-1, C-1 and Y-1, each containing a different pigment, were prepared in a similar manner to the preparation of Ink M-1, except that the magenta pigment dispersion (5% by mass in terms of solid content concentration of magenta pigment) was changed to the pigment dispersions as set forth below.

The same experiment and the evaluation as that carried out in Examples 1 and 2 were carried out using Inks K-1, C-1 and Y-1, respectively.

The results of the experiment and the evaluation proved that the inks achieved similar effects to that achieved in Examples 1 and 2.

Preparation of ink K-1

Ink K-1 was prepared in a similar manner to the preparation of Ink M-1, except that the resin-coated magenta pigment dispersion (5% by mass in terms of solid content concentration of magenta pigment) was changed to a resin-coated carbon black dispersion (2% by mass in terms of solid content concentration of carbon black) and a resin-coated cyan pigment dispersion (0.5% by mass in terms of solid content concentration of cyan pigment) as shown below.

<<Preparation of Resin-Coated Carbon Black Dispersion>>

The resin-coated carbon black dispersion was prepared in a similar manner to the preparation of the resin-coated magenta pigment dispersion, except that the magenta pigment PB15:3 pigment powder was changed to the same amount (10.0 parts) of carbon black (NIPEX 180-IQ, trade name, manufactured by Degussa).

<<Preparation of Resin-Coated Cyan Pigment Dispersion>>

The resin-coated cyan pigment dispersion was prepared in a similar manner to the preparation of the resin-coated magenta pigment dispersion, except that the magenta pigment PB15:3 pigment powder was changed to the same amount (10.0 parts) of PB15:3 pigment powder (PHTHALOCYANINE BLUE A220, trade name, manufactured by Dainichiseika Color & Chemicals Mfg. Co., Ltd.)

Preparation of Ink C-1

Ink C-1 was prepared in a similar manner to the preparation of Ink M-1, except that the resin-coated magenta pigment dispersion (5% by mass in terms of solid content concentration of magenta pigment) was changed to the resin-coated cyan pigment dispersion (3% by mass in terms of solid content concentration of cyan pigment).

Preparation of Ink Y-1

Ink Y-1 was prepared in a similar manner to the preparation of Ink M-1, except that the resin-coated magenta pigment dispersion (5% by mass in terms of solid content concentration of magenta pigment) was changed to a resin-coated yellow pigment dispersion (4.5% by mass in terms of solid content concentration of yellow pigment).

<<Preparation of Resin-Coated Yellow Pigment Dispersion>>

The resin-coated yellow pigment dispersion was prepared in a similar manner to the preparation of the resin-coated magenta pigment dispersion, except that the magenta pigment PB15:3 pigment powder was changed to the same amount (10.0 parts) of a yellow pigment (PIGMENT YELLOW 74).

In conventional liquid containers, an ink hole is extended by stretching a thin film with a punch, or a thin groove is formed only at a position at which the tip of the punch contacts first. Accordingly, it is not possible to extend the opening area in the sealing portion to a size greater than the size of the punch.

Further, when inks contain urea, decomposition of urea is caused when the ink is exposed to high-temperature conditions or stored over a long term, and ammonia and carbon dioxide tend to be generated. This phenomenon is particularly significant when a liquid having a pH at the alkali side is contained in the container. When a liquid containing urea, such as ink, is contained in a container for the purpose of storage or delivery, a gas may be generated over time etc., and the gas generated inside the container may impair the appearance of the container due to expansion, and the expansion may cause collapse or breakage of the container. Accordingly, there is a problem in that it is difficult to maintain not only the liquid by itself, but also as a container such as a cartridge, in a stable manner.

Moreover, when the container is installed in an apparatus by taking off the cap from the container containing ink or the like at the time of replacement or the like, ink may leak from the opened cap, or the hands of the operator may get dirty by the ink adhering to the cap. Therefore, from the viewpoint of ease of handling, improvements in preventing the contamination have been highly desired.

The invention has been made in view of the aforementioned circumstances, and aims to provide an image forming liquid cartridge that achieves a large opening area in the sealing portion while maintaining a certain level of strength, and suppressed deformation over time under a high temperature environment or during a long-term storage, even with a liquid composition containing urea that easily generates a gas. The invention also aims to provide an image forming apparatus that enables stable image formation over a long term.

According to the invention, it is possible to provide an image forming liquid cartridge that achieves a large opening area in the sealing portion while maintaining a certain level of strength, and suppressed deformation over time under a high temperature environment or during a long-term storage, even with a liquid composition containing urea that easily generates a gas.

Further, according to the invention, it is possible to provide an image forming apparatus that enables stable image formation over a long term.

What is claimed is:

1. An image forming liquid cartridge comprising:

a container having an opening portion from which an image forming liquid is fed or discharged;

a cap portion connected to the opening portion; and an image forming liquid contained in the container, the image forming liquid comprising a colorant, urea and water, and having a pH of 7.5 or more, wherein the cap portion comprises a sealing portion that seals the opening portion, a contact portion provided at the center of the sealing portion and adapted such that a punch member that punches the sealing portion contacts the contact portion, and at least one first breakage portion that extends from the contact portion to an outer periphery of the sealing portion, and has a thickness of from 0.1 mm to 0.5 mm, the thickness of the at least one first breakage portion being smaller than a thickness of the sealing portion.

2. The image forming liquid cartridge according to claim 1, wherein the image forming liquid cartridge comprises two or more of the first breakage portions.

3. The image forming liquid cartridge according to claim 1, wherein the content of urea contained in the image forming liquid is from 1.0% by mass to 10.0% by mass with respect to the total mass of the image forming liquid.

4. The image forming liquid cartridge according to claim 1, wherein a breakage induction portion is provided at the outer periphery of the contact portion, the breakage induction portion having a smaller thickness than the thickness of the sealing portion and being connected to the at least one first breakage portion and adapted so as to induce breakage of the first breakage portion.

5. The image forming liquid cartridge according to claim 1, wherein the contact portion is recessed from a front surface of the sealing portion and protrudes from a reverse surface of the sealing portion.

6. The image forming liquid cartridge according to claim 1, wherein the at least one first breakage portion is a curved groove when the sealing portion is viewed in plan view.

7. The image forming liquid cartridge according to claim 1, wherein the at least one first breakage portion is an S-shaped groove when the sealing portion is viewed in plan view.

8. The image forming liquid cartridge according to claim 1, further comprising a plurality of second breakage portions provided along an outer periphery of the sealing portion at a certain interval, the second breakage portions being connected to the at least one first breakage portion and having a smaller thickness than the thickness of the sealing portion.

9. The image forming liquid cartridge according to claim 1, wherein the cap portion is attached to the opening portion.

10. The image forming liquid cartridge according to claim 1, further comprising an elastic sealing member having a slit, the elastic sealing member being provided at the cap portion at a position closer to an opening of the cap portion than the sealing portion.

11. The image forming liquid cartridge according to claim 1, wherein the cap portion comprises a cylindrical body and a claw portion formed as a protrusion at an outer wall of the cylindrical body, the claw portion being adapted to be engaged with an engagement portion formed at an inner wall of the opening portion.

12. The image forming liquid cartridge according to claim 11, wherein a space, in which a tip of the cylindrical body can be deformed in a direction of increased diameter, is provided at the inner wall of the opening portion at which the engagement portion is formed.

13. An image forming apparatus comprising: the image forming liquid cartridge according to claim 1; and a punch member that punches the sealing portion of the image forming liquid cartridge, wherein, in the image forming liquid cartridge, the punch member has a different shape than the shape of the at least one first breakage portion.

* * * * *